US008459181B2

(12) United States Patent
Saito

(10) Patent No.: US 8,459,181 B2
(45) **Date of Patent: *Jun. 11, 2013**

(54) SHEET PROCESSING APPARATUS

(75) Inventor: Hirofumi Saito, Ibaraki (JP)

(73) Assignee: Komori Corporation, Tokyo (JP)

( * ) Notice: Subject to any disclaimer, the term of this patent is extended or adjusted under 35 U.S.C. 154(b) by 917 days.

This patent is subject to a terminal disclaimer.

(21) Appl. No.: 12/070,625

(22) Filed: Feb. 20, 2008

(65) Prior Publication Data

US 2009/0008853 A1 Jan. 8, 2009

(30) Foreign Application Priority Data

Feb. 21, 2007 (JP) ..... 2007-040449

(51) Int. Cl.
*B41F 7/02* (2006.01)

(52) U.S. Cl.
USPC ..... 101/218; 101/184; 101/185; 101/247

(58) Field of Classification Search
USPC ..... 101/218, 247, 183, 184, 185; 118/46, 118/212, 227, 244, 255, 262
See application file for complete search history.

(56) References Cited

U.S. PATENT DOCUMENTS

| | | | | |
|---|---|---|---|---|
| 4,372,201 | A * | 2/1983 | Dudziak et al. | 100/7 |
| 4,458,591 | A * | 7/1984 | Guaraldi | 101/247 |
| 4,676,158 | A * | 6/1987 | Ishii et al. | 101/218 |
| 5,320,038 | A | 6/1994 | Fischer | |
| 5,588,362 | A * | 12/1996 | Sugiyama et al. | 101/218 |
| 6,213,016 | B1 * | 4/2001 | Tsunashima | 101/218 |
| 6,772,709 | B2 * | 8/2004 | Shibata | 118/46 |
| 2002/0096070 | A1 * | 7/2002 | Friedrichs et al. | 101/247 |
| 2006/0201352 | A1 | 9/2006 | Saito | |
| 2006/0266238 | A1 | 11/2006 | Derhardt | |
| 2007/0221075 | A1 * | 9/2007 | Kundgen et al. | 101/218 |

FOREIGN PATENT DOCUMENTS

| | | | |
|---|---|---|---|
| DE | 10 2004 016 673 | A1 | 10/2005 |
| EP | 1 319 508 | A1 | 6/2003 |
| JP | 02-098444 | | 4/1990 |
| JP | 07-299897 | | 11/1995 |
| JP | 2585995 | Y | 9/1998 |
| JP | 2001-353843 | | 12/2001 |
| JP | 2003-182031 | A | 7/2003 |
| JP | 2004 050849 | A | 2/2004 |
| JP | 2006-250202 | A | 9/2006 |

* cited by examiner

*Primary Examiner* — Ren Yan
(74) *Attorney, Agent, or Firm* — Blakely, Sokoloff, Taylor & Zafman

(57) ABSTRACT

A sheet processing apparatus includes a first cylinder, second cylinder, third cylinder, first driving device, second driving device, third driving device, gap amount input device, and controller. The first cylinder receives a sheet from an upstream transport cylinder and holds the sheet. The second cylinder is disposed to oppose the first cylinder and prints/coats the sheet held by the first cylinder. The third cylinder is disposed to oppose the first cylinder and supplies ink/varnish to a circumferential surface of the first cylinder. The first driving device adjusts a gap amount between the first cylinder and upstream transport cylinder. The second driving device adjusts the position of the second cylinder with respect to the first cylinder. The third driving device adjusts the position of the third cylinder with respect to the first cylinder. The gap amount input device inputs the gap amount between the first cylinder and upstream transport cylinder. The controller controls the first, second, and third driving devices on the basis of the gap amount input from the gap amount input device.

16 Claims, 15 Drawing Sheets

SHEET PROCESSING APPARATUS

BACKGROUND OF THE INVENTION

The present invention relates to a sheet processing apparatus which prints or coats the two surfaces, obverse, and reverse of a sheet.

Conventionally, as shown in Japanese Patent Laid-Open No. 2003-182031, a sheet processing apparatus has been proposed which comprises a blanket cylinder which opposes the last impression cylinder of a printing unit and receives a sheet from the last impression cylinder, a lower blanket cylinder which opposes the blanket cylinder in the upstream sheet convey direction of a position where the blanket cylinder opposes the last impression cylinder, and an upper blanket cylinder which opposes the blanket cylinder in the downstream sheet convey direction of the opposing point where the blanket cylinder opposes the last impression cylinder and supplies varnish to the surface of the sheet. As shown in Japanese Utility Model Registration No. 2,585,995, a sheet processing apparatus has been proposed in which an eccentric bearing supports a blanket cylinder opposing an impression cylinder and a cylinder throw on/off mechanism pivots the eccentric bearing to throw on/off the blanket cylinder.

In the conventional sheet processing apparatuses described above, when transferring a sheet from the last impression cylinder to the blanket cylinder, if the sheet is scratched depending on the thickness or material of the sheet to be processed, the packing combination of the blanket cylinder is changed to change the gap amount between the circumferential surfaces of the last impression cylinder and blanket cylinder. Accordingly, each time the sheet type changes, the packing combination of the blanket cylinder must be changed, which requires time. This increases the load to the operator to degrade the productivity.

When the packing combination of the blanket cylinder changes, the printing pressure between the blanket cylinder and upper blanket cylinder and that between the blanket cylinder and lower blanket cylinder change to degrade the printing quality. To prevent this, the eccentric bearings of the upper and lower blanket cylinders are pivoted, thus adjusting the printing pressures of the upper and lower blanket cylinders. As this adjustment must be performed repeatedly while checking the quality, a large amount of paper is wasted. Also, this adjustment must be performed each time the packing combination of the blanket cylinder changes, requiring time.

SUMMARY OF THE INVENTION

It is an object of the present invention to provide a sheet processing apparatus in which an adjustment time to maintain the processing quality of a sheet is shortened to improve the productivity.

In order to achieve the above object, according to the present invention, there is provided a sheet processing apparatus comprising a first cylinder which receives a sheet from an upstream transport cylinder and holds the sheet, a second cylinder which is disposed to oppose the first cylinder and prints/coats the sheet held by the first cylinder, a third cylinder which is disposed to oppose the first cylinder and supplies ink/varnish to a circumferential surface of the first cylinder, first driving means for adjusting a gap amount between the first cylinder and the upstream transport cylinder, second driving means for adjusting a position of the second cylinder with respect to the first cylinder, third driving means for adjusting a position of the third cylinder with respect to the first cylinder, gap amount input means for inputting the gap amount between the first cylinder and the upstream transport cylinder, and control means for controlling the first driving means, the second driving means, and the third driving means on the basis of the gap amount input from the gap amount input means.

DESCRIPTION OF THE PREFERRED EMBODIMENTS

A sheet processing apparatus according to the first embodiment of the present invention will be described with reference to FIGS. 1 to 9C.

Figure 1:
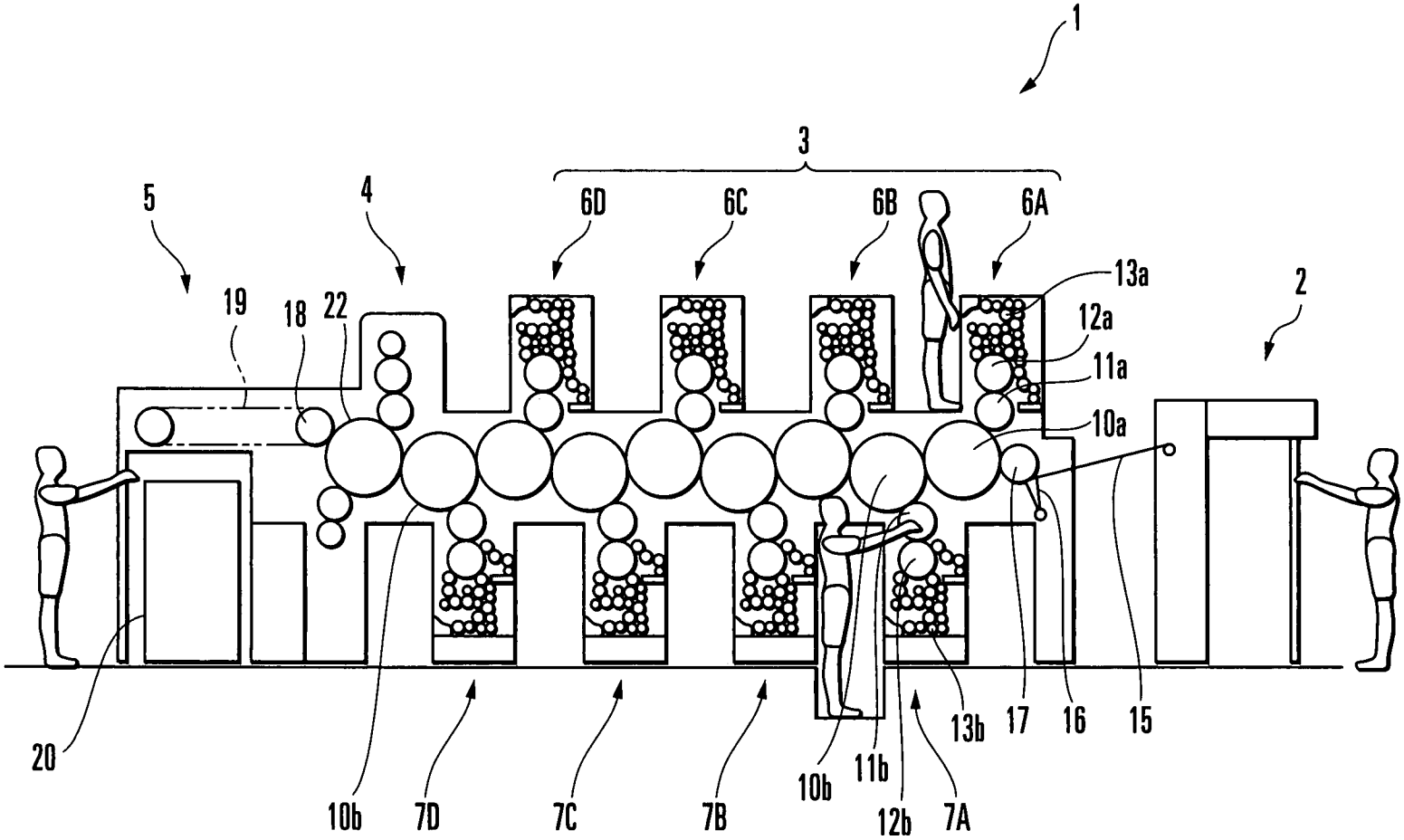
FIG. 1 is a side view of a sheet-fed rotary printing press to which a sheet processing apparatus according to the present invention is applied.

As shown in FIG. 1, a sheet-fed rotary printing press 1 to which a sheet processing apparatus according to the first embodiment is applied comprises a feeder 2 for feeding a sheet, a printing unit 3 serving as a liquid transfer device which prints the sheet fed from the feeder 2, a coating unit 4 serving as a liquid transfer device which coats with varnish one or both of the obverse and reverse of the sheet printed by the printing unit 3, and a delivery unit 5 serving as a delivery unit to which the sheet coated by the coating unit 4 is delivered. The printing unit 3 comprises first to fourth obverse printing units 6A to 6D serving as an obverse processing unit, and first to fourth reverse printing units 7A to 7D serving as a reverse processing unit.

Each of the obverse printing units 6A to 6D comprises a double-diameter impression cylinder 10*a* (convey means) serving as a transport cylinder which has grippers (sheet holding means) for gripping a sheet in its peripheral portion, a blanket cylinder 11*a* serving as a transfer cylinder which opposes the upper portion of the impression cylinder 10*a*, a plate cylinder 12*a* which opposes the upper portion of the blanket cylinder 11*a*, and an inking unit 13*a* serving as a liquid supply unit which supplies ink as a liquid to the plate cylinder 12*a*.

Each of the reverse printing units 7A to 7D comprises a double-diameter impression cylinder 10*b* (convey means) serving as a transport cylinder which has grippers (sheet holding means) for gripping a sheet in its peripheral portion, a blanket cylinder 11*b* serving as a transfer cylinder which opposes the lower portion of the impression cylinder 10*b*, a plate cylinder 12*b* which opposes the lower portion of the blanket cylinder 11*b*, and an inking unit 13*b* serving as a liquid supply unit which supplies ink as a liquid to the plate cylinder 12*b*.

In this arrangement, the leading edge of a sheet supplied from the feeder 2 onto a feeder board 15 is gripped by a swing arm shaft pregripper 16 and gripping-changed to the grippers of the impression cylinder 10*a* of the first obverse printing unit 6A. The sheet gripped by the grippers of the impression cylinder 10*a* is printed in the first color as it passes between the impression cylinder 10*a* and blanket cylinder 11*a*. The sheet the obverse of which is printed in the first color is gripping-changed to the impression cylinder 10*b* of the first reverse printing unit 7A, and is printed in the first color on its reverse as it passes between the impression cylinder 10*b* and blanket cylinder 11*b*.

Subsequently, second to fourth obverse printing units 6B to 6D and second to fourth reverse printing units 7B to 7D print in the second to fourth colors. The coating unit 4 coats the sheet, which is printed in four colors on each of its obverse and reverse, with varnish as a liquid. The coated sheet is gripping-changed to the delivery grippers (sheet holding means; not shown) of a delivery chain 19 (convey means) of the delivery unit 5, is conveyed by the delivery chain 19, and falls on a delivery pile 20 and piles there.

Figure 2:
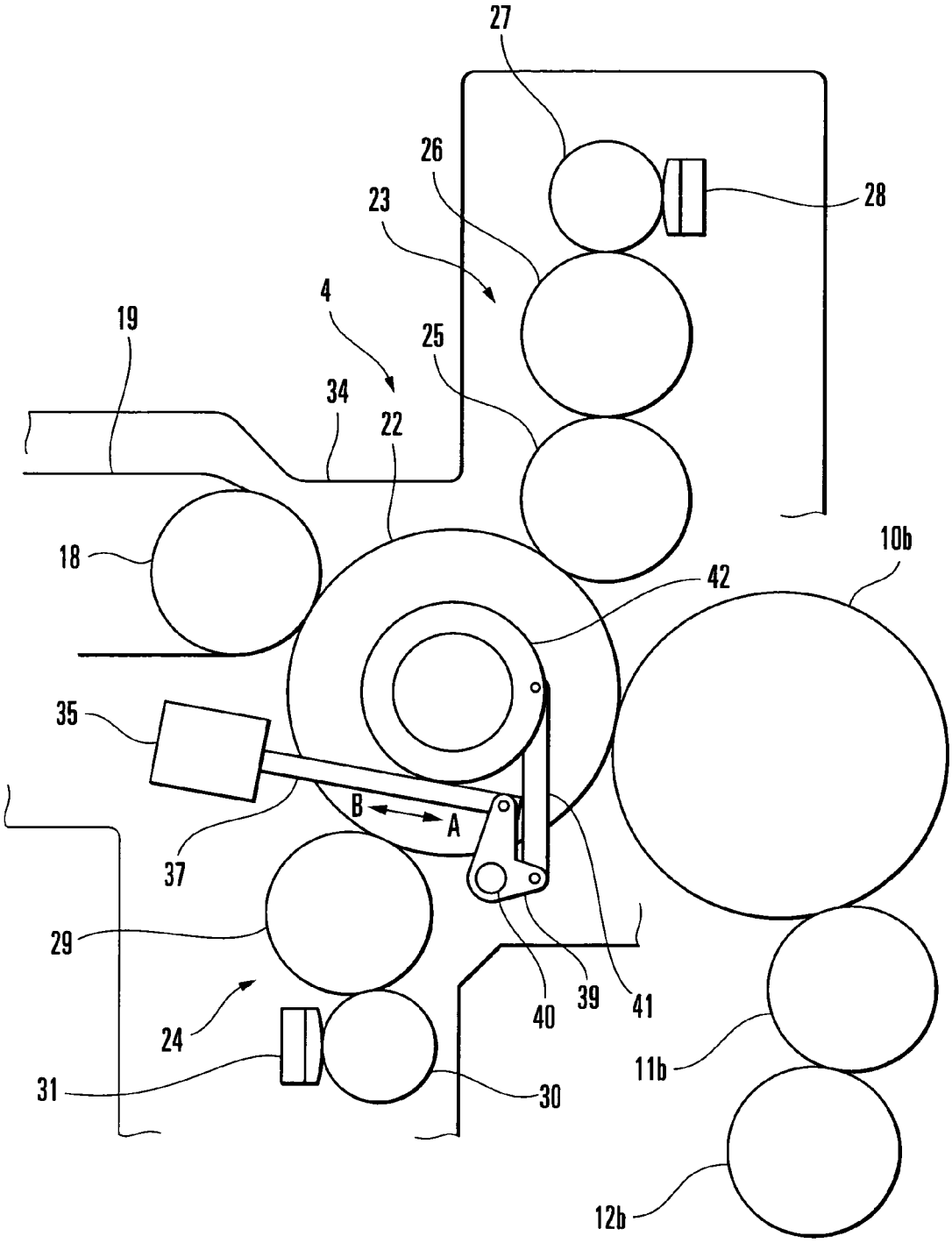
FIG. 2 is a side view of the main part showing cylinder arrangement in the sheet-fed rotary printing press shown in FIG. 1.

As shown in FIG. 2, the coating unit 4 comprises a coater double-diameter blanket cylinder 22 (first cylinder) serving as a reverse processing cylinder which opposes the impression cylinder 10*b* serving as the transport cylinder of the fourth reverse printing unit 7D. The coating unit 4 further comprises a first varnish coating device 23 (obverse processing means) which coats the obverse of the printed sheet, and a second varnish coating device 24 (reverse processing means) which coats the reverse of the printed sheet.

The first varnish coating device 23 comprises an upper blanket cylinder 25 (second cylinder) serving as an obverse processing cylinder which is disposed in the downstream sheet convey direction of a transfer point where the sheet held by the impression cylinder 10*b* is transferred to the coater double-diameter blanket cylinder 22, i.e., the opposing point of the coater double-diameter blanket cylinder 22 and impression cylinder 10*b*, and opposes the coater double-diameter blanket cylinder 22, a varnish film formation cylinder 26 which opposes the upper blanket cylinder 25, an anilox roller 27 which opposes the varnish film formation cylinder 26, and a chamber coater 28 which supplies varnish to the anilox roller 27. The anilox roller 27 and chamber coater 28 constitute an obverse liquid supply means.

The varnish supplied from the chamber coater 28 to the anilox roller 27 is transferred to the upper blanket cylinder 25 through the varnish film formation cylinder 26 and coats the printed obverse of the sheet passing between the upper blanket cylinder 25 and coater double-diameter blanket cylinder 22. When the sheet passes between the upper blanket cylinder 25 and coater double-diameter blanket cylinder 22, the varnish transferred from a lower blanket cylinder 29 (third cylinder) serving as the reverse blanket cylinder of the second varnish coating device 24 to the circumferential surface of the coater double-diameter blanket cylinder 22 coats the printed reverse of the sheet with the printing pressure of the upper blanket cylinder 25.

The second varnish coating device 24 comprises the lower blanket cylinder 29 which is disposed in the upstream rotational direction of the coater double-diameter blanket cylinder 22 of the opposing point of the coater double-diameter blanket cylinder 22 and impression cylinder lob and opposes the coater double-diameter blanket cylinder 22, an anilox roller 30 which opposes the lower blanket cylinder 29, and a chamber coater 31 which supplies the varnish to the anilox roller 30. The varnish supplied from the chamber coater 31 to the anilox roller 30 is transferred to the circumferential surface of the coater double-diameter blanket cylinder 22 through the lower blanket cylinder 29. The anilox roller 30 and chamber coater 31 constitute a reverse liquid supply means.

Figure 4:
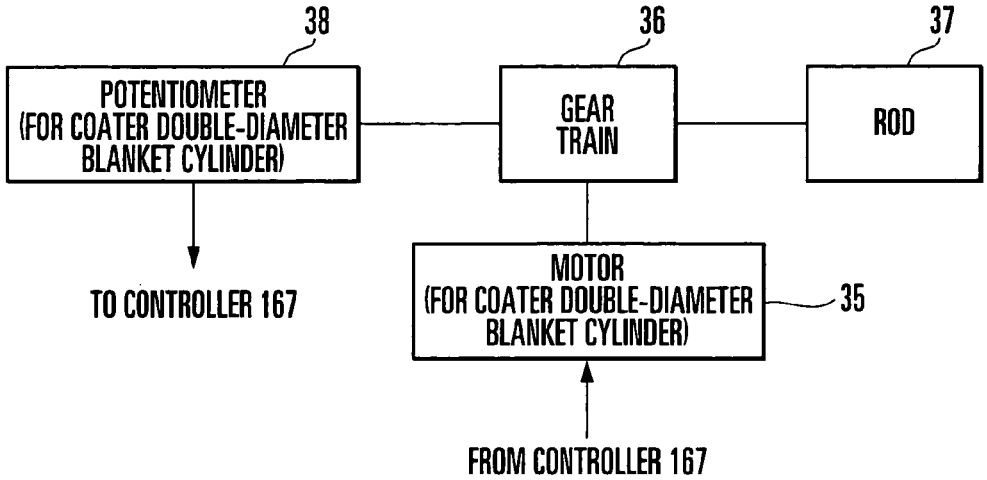
FIG. 4 is a view showing the connection state of the driving system of a motor for a coater double-diameter blanket cylinder shown in FIG. 1.

As shown in FIG. 4, a motor 35 (first driving means) for the coater double-diameter blanket cylinder which is attached to the frames 34 is connected to one end of a rod 37 through a gear train 36. When the motor 35 is driven in one direction, the rod 37 moves in the direction of an arrow A in FIG. 2 through the gear train 36. When the motor 35 is driven in the opposite direction, the rod 37 moves in the direction of an arrow B in FIG. 2 through the gear train 36. A potentiometer 38 (detection means) for the coater double-diameter blanket cylinder detects the current position of the coater double-diameter blanket cylinder 22. A controller 167 (to be described later) detects (calculates) a phase angle $\alpha$ of the motor 35 on the basis of an output from the potentiometer 38.

As shown in FIG. 2, an almost L-shaped lever 39 is fixed to one end of a shaft 40 which is rotatably supported between the pair of frames 34. One end of the lever 39 is pivotally mounted on the other end of the rod 37, and its other end is pivotally mounted on one end of a rod 41. A lever (not shown) is fixed to the other end of the shaft 40. An end of the lever is pivotally mounted on one end of a rod (not shown). The other end of this rod is pivotally mounted on an eccentric bearing (to be described later) which rotatably supports the other end shaft of the coater double-diameter blanket cylinder 22.

A pair of eccentric bearings 42 which rotatably support the two end shafts of the coater double-diameter blanket cylinder 22 are fitted on the pair of frames 34. The other end of the rod 41 is pivotally mounted on the corresponding eccentric bearing 42. In this arrangement, when the rod 37 moves in the direction of the arrow A and the lever 39 accordingly pivots clockwise about the shaft 40 as the center, the coater double-diameter blanket cylinder 22 separates from the impression cylinder 10*b* through the rod 41 and the corresponding eccentric bearing 42. This increases the gap amount between the circumferential surfaces of the coater double-diameter blanket cylinder 22 and impression cylinder 10*b*.

When the rod 37 moves in the direction of the arrow B and the lever 39 accordingly pivots counterclockwise about the shaft 40 as the center, the coater double-diameter blanket cylinder 22 moves close to the impression cylinder 10*b* through the rod 41 and the corresponding eccentric bearing 42. This decreases the gap amount between the circumferential surfaces of the coater double-diameter blanket cylinder 22 and impression cylinder 10*b*.

Figure 3:
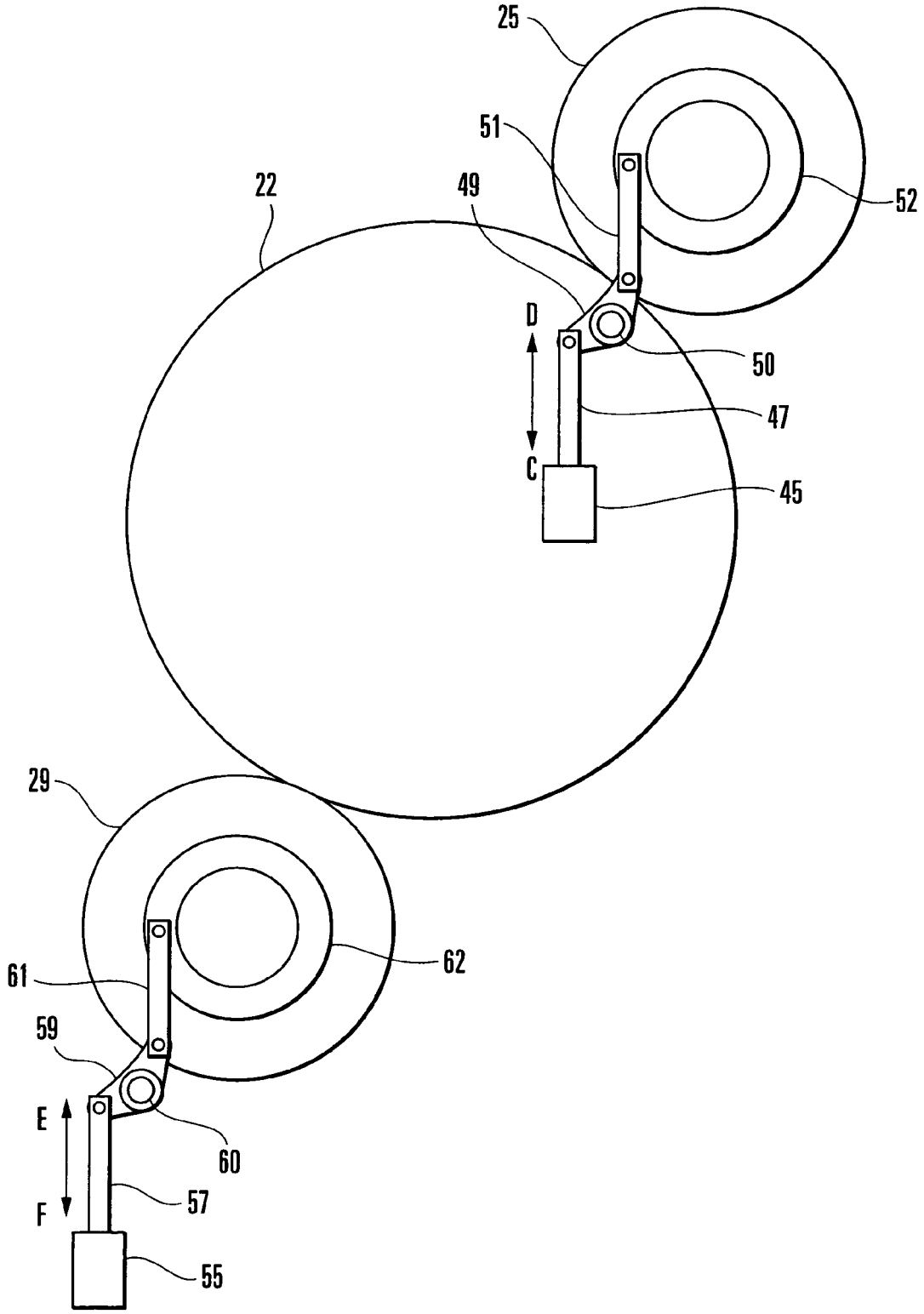
FIG. 3 is a side view of the main part to describe the second and third driving devices which adjust the positions of an upper blanket cylinder and lower blanket cylinder shown in FIG. 1.
Figure 5:
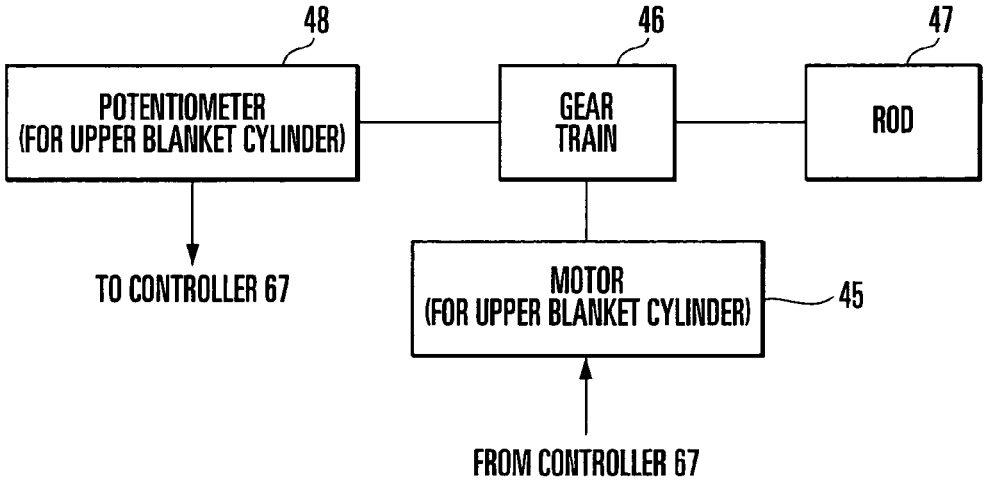
FIG. 5 is a view showing the connection state of the driving system of a motor for the upper blanket cylinder shown in FIG. 1.
Figure 7A:
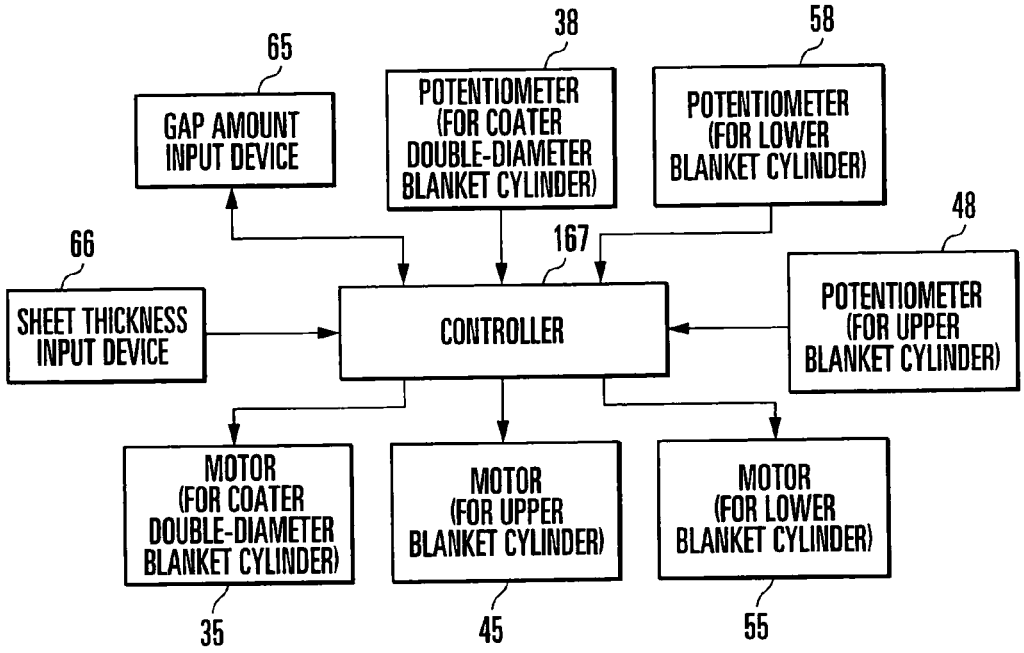
FIG. 7A is a block diagram showing the electrical arrangement of a sheet processing apparatus according to the first embodiment of the present invention.

As shown in FIG. 3, a motor 45 (second driving means) for the upper blanket cylinder is attached to the frames 34. As shown in FIG. 5, the motor 45 is connected to one end of a rod 47 through a gear train 46. When the motor 45 is driven in one direction, the rod 47 moves in the direction of an arrow C in FIG. 3 through the gear train 46. When the motor 45 is driven in the opposite direction, the rod 47 moves in the direction of an arrow D in FIG. 3 through the gear train 46. A potentiometer 48 for the upper blanket cylinder detects the current position of the upper blanket cylinder 25 and outputs it to the controller 167 (FIG. 7A). The controller 167 detects (calculates) a phase angle β of the motor 45 on the basis of an output from the potentiometer 48.

As shown in FIG. 3, an almost L-shaped lever 49 is fixed to one end of a shaft 50 which is rotatably supported between the pair of frames 34. One end of the lever 49 is pivotally mounted on the other end of the rod 47, and its other end is pivotally mounted on one end of a rod 51. A lever (not shown) is fixed to the other end of the shaft 50. An end of the lever is pivotally mounted on one end of a rod (not shown). The other end of this rod is pivotally mounted on an eccentric bearing (to be described later) which rotatably supports the other end shaft of the upper blanket cylinder 25.

A pair of eccentric bearings 52 which rotatably support the two end shafts of the upper blanket cylinder 25 are fitted on the pair of frames 34. The other end of the rod 51 is pivotally mounted on the corresponding eccentric bearing 52. When the rod 47 moves in the direction of the arrow C and the lever 49 accordingly pivots counterclockwise about the shaft 50 as the center, the upper blanket cylinder 25 moves close to the coater double-diameter blanket cylinder 22 through the rod 51 and the corresponding eccentric bearing 52. This decreases the gap amount between the circumferential surfaces of the coater double-diameter blanket cylinder 22 and upper blanket cylinder 25.

When the rod 47 moves in the direction of the arrow D and the lever 49 accordingly pivots clockwise about the shaft 50 as the center, the upper blanket cylinder 25 separates from the coater double-diameter blanket cylinder 22 through the rod 51 and the corresponding eccentric bearing 52. This increases the gap amount between the circumferential surfaces of the coater double-diameter blanket cylinder 22 and upper blanket cylinder 25.

Figure 6:
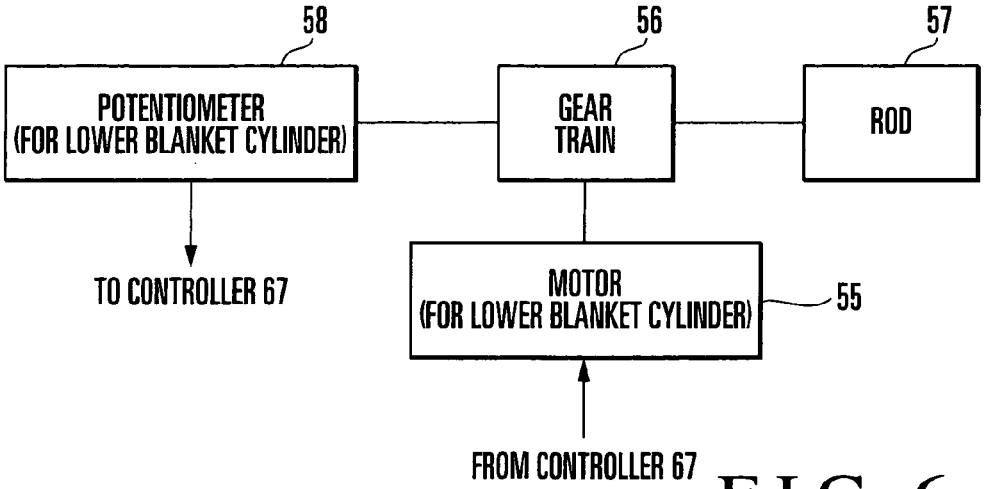
FIG. 6 is a view showing the connection state of the driving system of a motor for the lower blanket cylinder shown in FIG. 1.

As shown in FIG. 3, a motor 55 (third driving means) for the lower blanket cylinder is attached to the frames 34. As shown in FIG. 6, the motor 55 is connected to one end of a rod 57 through a gear train 56. When the motor 55 is driven in one direction, the rod 57 moves in the direction of an arrow E in FIG. 3 through the gear train 56. When the motor 55 is driven in the opposite direction, the rod 57 moves in the direction of an arrow F in FIG. 3 through the gear train 56. A potentiometer 58 for the lower blanket cylinder detects the current position of the lower blanket cylinder 29 and outputs it to the controller 167 (FIG. 7A). The controller 167 detects (calculates) a phase angle γ of the motor 55 on the basis of an output from the potentiometer 58.

As shown in FIG. 3, an almost L-shaped lever 59 is fixed to one end of a shaft 60 which is rotatably supported between the pair of frames 34. One end of the lever 59 is pivotally mounted on the other end of the rod 57, and its other end is pivotally mounted on one end of a rod 61. A lever (not shown) is fixed to the other end of the shaft 60. An end of the lever is pivotally mounted on one end of a rod (not shown). The other end of this rod is pivotally mounted on an eccentric bearing (to be described later) which rotatably supports the other end shaft of the lower blanket cylinder 29.

A pair of eccentric bearings 62 which rotatably support the two end shafts of the lower blanket cylinder 29 are fitted on the pair of frames 34. The other end of the rod 61 is pivotally mounted on the corresponding eccentric bearing 62. When the rod 57 moves in the direction of the arrow E, the lever 59 pivots clockwise about the shaft 60 as the center. Thus, the lower blanket cylinder 29 moves toward the coater double-diameter blanket cylinder 22 through the rod 61 and the corresponding eccentric bearing 62. This increases the printing pressure between the coater double-diameter blanket cylinder 22 and lower blanket cylinder 29.

When the rod 57 moves in the direction of the arrow F, the lever 59 pivots counterclockwise about the shaft 50 as the center. Thus, the lower blanket cylinder 29 separates from the coater double-diameter blanket cylinder 22 through the rod 61 and the corresponding eccentric bearing 62. This decreases the printing pressure between the coater double-diameter blanket cylinder 22 and lower blanket cylinder 29.

The sheet processing apparatus according to this embodiment comprises, in addition to the potentiometers 38, 48, and 58 and motors 35, 45, and 55 described above, the controller 167 (control means), a gap amount input device 65, and a sheet thickness input device 66, as shown in FIG. 7A. The controller 167 is connected to the potentiometers 38, 48, and 58, motors 35, 45, and 55, gap amount input device 65, and sheet thickness input device 66. A gap amount t between the coater double-diameter blanket cylinder 22 and impression cylinder 10*b* is input to the gap amount input device 65, and the thickness of the sheet to be conveyed is input to the sheet thickness input device 66. The input devices 65 and 66 comprise a key input device to which numerical values are input by the operator's key operation.

Figure 7B:
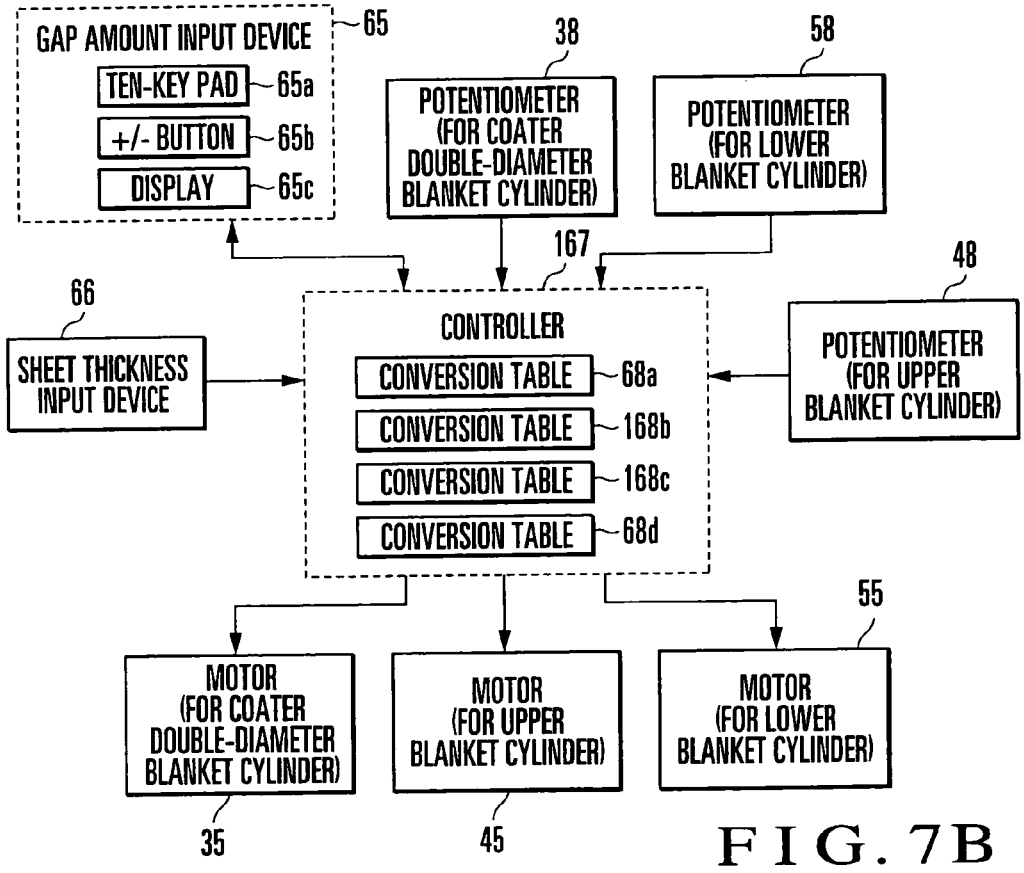
FIG. 7B is a block diagram of a controller and gap amount input device shown in FIG. 7A.

Of these constituent members, as shown in FIG. 7B, the gap amount input device 65 comprises a ten-key pad 65*a* to which the numerical value of the gap amount t is input, a +/− button 65*b* which changes (increases or decreases) the input (displayed) gap amount t, and a display 65*c* which displays the value of the input or changed gap amount t. The gap amount t to be displayed on the display 65*c* is input from the sheet thickness input device 66, ten-key pad 65*a*, and +/− button 65*b* which are manipulated by the operator. More specifically, when the operator inputs a sheet thickness k from the key input device (not shown) of the sheet thickness input device 66, the controller 167 converts the sheet thickness k input from the sheet thickness input device 66 into the gap amount t by looking up the fourth table (to be described later), and displays the gap amount t on the display 65*c*.

When the operator inputs the gap amount t from the ten-key pad 65*a*, the controller 167 displays (sets) the gap amount t input from the ten-key pad 65*a* on the display 65*c*. When the operator adjusts the displayed (set) gap amount t using the +/− button 65*b*, the controller 167 displays the adjusted gap amount t on the display 65*c*. When the sheet thickness is changed from k1 to k2, the operator inputs the sheet thickness k2 to the sheet thickness input device 66. The controller 167 changes the gap amount from t1 to t2 using the input sheet thickness k2 and the fourth table (to be described later), and displays the gap amount t2 on the display 65*c*.

Figure 8A:
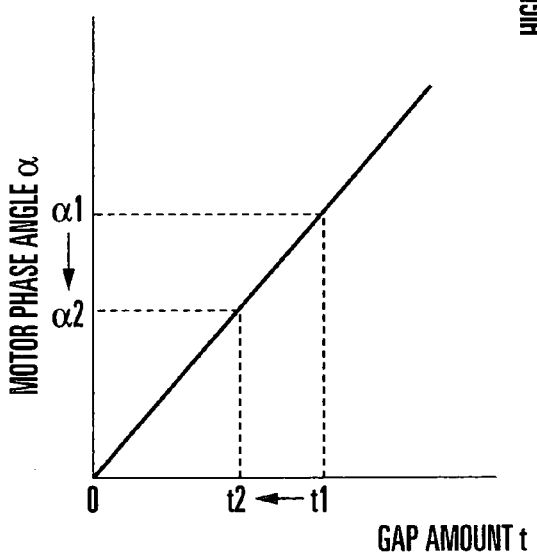
FIG. 8A is a graph defining the relationship "between a gap amount t and a motor phase angle $\alpha$" of the first conversion table shown in FIG. 7B.
Figure 8B:
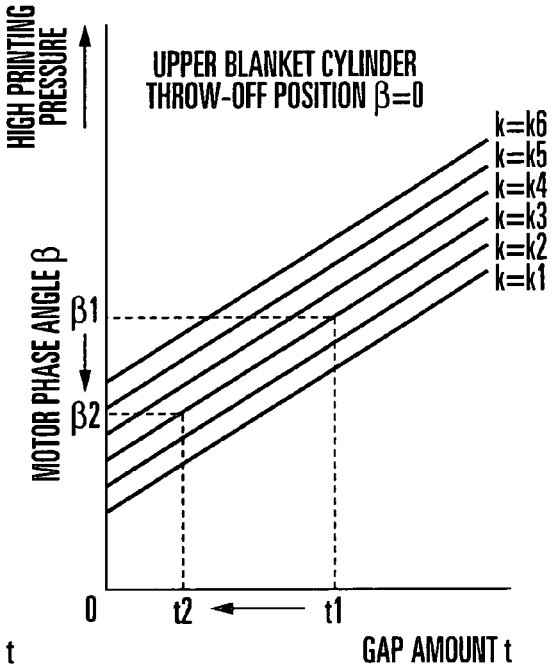
FIG. 8B is a graph defining the relationship "between the gap amount t and a motor phase angle $\beta$ with respect to a sheet thickness k" of the second conversion table shown in FIG. 7B.
Figure 8C:
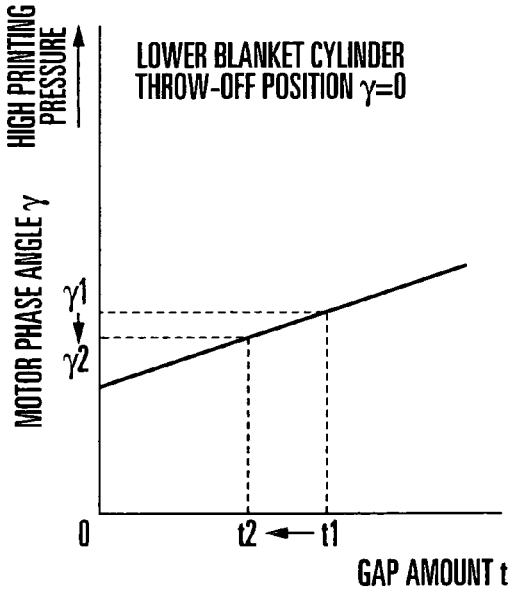
FIG. 8C is a graph defining the relationship "between the gap amount t and a motor phase angle $\gamma$" of the third conversion table shown in FIG. 7B.
Figure 8D:
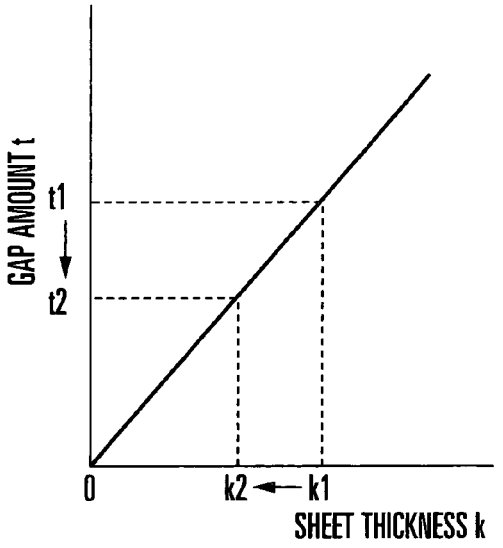
FIG. 8D is a graph defining the relationship "between the sheet thickness k and gap amount t" of the fourth conversion table shown in FIG. 7B.

As shown in FIG. 7B, the controller 167 has a first conversion table 68*a* defining the relationship "between the gap amount t and the phase angle α of the motor 35" (FIG. 8A), a second conversion table 168*b* defining the relationship "between the gap amount t and the phase angle β of the motor 45 with respect to the sheet thickness k" (FIG. 8B), a third conversion table 168*c* defining the relationship "between the gap amount t and the phase angle γ of the motor 55" (FIG. 8C), and a fourth conversion table 68*d* defining the relationship "between the sheet thickness k and gap amount t" (FIG. 8D). As shown in FIG. 8D, the controller 167 converts the sheet thickness k input from the sheet thickness input device 66 into the gap amount t by looking up the fourth conversion table 68*d*. The conversion table 68*d* may be provided to the sheet thickness input device 66 or gap amount input device 65.

The controller 167 controls the phase angle α of the motor 35 on the basis of an output from the conversion table 68*a* which corresponds to the gap amount t2 input to the gap amount input device 65, and the output from the potentiometer 38. The controller 167 controls the phase angle β of the motor 45 on the basis of an output from the conversion table 168*b* which corresponds to a gap amount t2 and a sheet thickness k3 input to the sheet thickness input device 66, and the output from the potentiometer 48. The controller 167 controls the phase angle γ of the motor 55 on the basis of an output from the conversion table 168*c* which corresponds to the gap amount t2, and the output from the potentiometer 58.

The conversion tables will be described in detail with reference to FIGS. 8A to 8C. Upon reading the gap amount t=t1 from the gap amount input device 65, the controller 167 obtains a phase angle α1 of the motor 35 by looking up the conversion table 68*a*. When the gap amount is changed from t1 to t2, the controller 167 changes the phase angle of the motor 35 from α1 to α2 by looking up the conversion table 68*a*.

This will be described in more detail. When transferring the sheet from the impression cylinder 10*b* to the coater double-diameter blanket cylinder 22, the sheet may be scratched. In this case, to prevent a scratch, the gap amount t1 between the impression cylinder 10*b* and coater double-diameter blanket cylinder 22 is changed to t2. The change to the gap amount t2 is performed by changing the phase angle of the motor 35 from α1 to α2. In this example, as a countermeasure for a scratch, the gap amount t is changed in the decreasing direction. Alternatively, the gap amount t is changed in the increasing direction. When adjusting the gap amount t, the gap amount t is increased or decreased selectively in accordance with the conditions of the sheet, such as the quality or thickness, and the location of the scratch.

When the gap for the coater double-diameter blanket cylinder 22 is adjusted as described above, the printing pressure between the coater double-diameter blanket cylinder 22 and upper blanket cylinder 25 changes from that obtained before gap adjustment. In order to maintain the printing pressure between the two cylinders 22 and 25 obtained before gap adjustment, the controller 167 obtains the phase angle β of the motor 45 from the gap amount t and the sheet thickness k by looking up the conversion table 168*b*. When the sheet thickness k=k3 and the gap amount t1 is α1, a phase angle β1 of the motor 45 is obtained from the conversion table 168*b*. Note that the sheet thickness k is a value input to the sheet thickness input device 66.

As the gap amount is changed from t1 to t2, the phase angle of the motor 45 is also changed from β1 to β2. In this manner, when the phase angle of the motor 35 is changed to α2 and the phase angle of the motor 45 is changed to β2, the printing pressure between the coater double-diameter blanket cylinder 22 and upper blanket cylinder 25 which is obtained after the change is set to be equal to that obtained before the change.

When the gap for the coater double-diameter blanket cylinder 22 is adjusted as described above, the printing pressure between the coater double-diameter blanket cylinder 22 and lower blanket cylinder 29 changes from that obtained before gap adjustment. In order to maintain the printing pressure between the two cylinders 22 and 29 obtained before gap adjustment, the controller 167 obtains the phase angle γ of the motor 55 from the gap amount t by looking up the conversion table 168*c*. More specifically, when the gap amount t is t1, a phase angle γ1 of the motor 55 is obtained from the conversion table 168*c*.

As the gap amount t is changed from t1 to t2, the phase angle of the motor 55 is also changed from γ1 to γ2. In this manner, when the phase angle of the motor 35 is changed to α2 and the phase angle of the motor 55 is changed to γ2, the printing pressure between the coater double-diameter blanket cylinder 22 and lower blanket cylinder 29 which is obtained after the change is set to be equal to that obtained before the change.

Figure 9A:
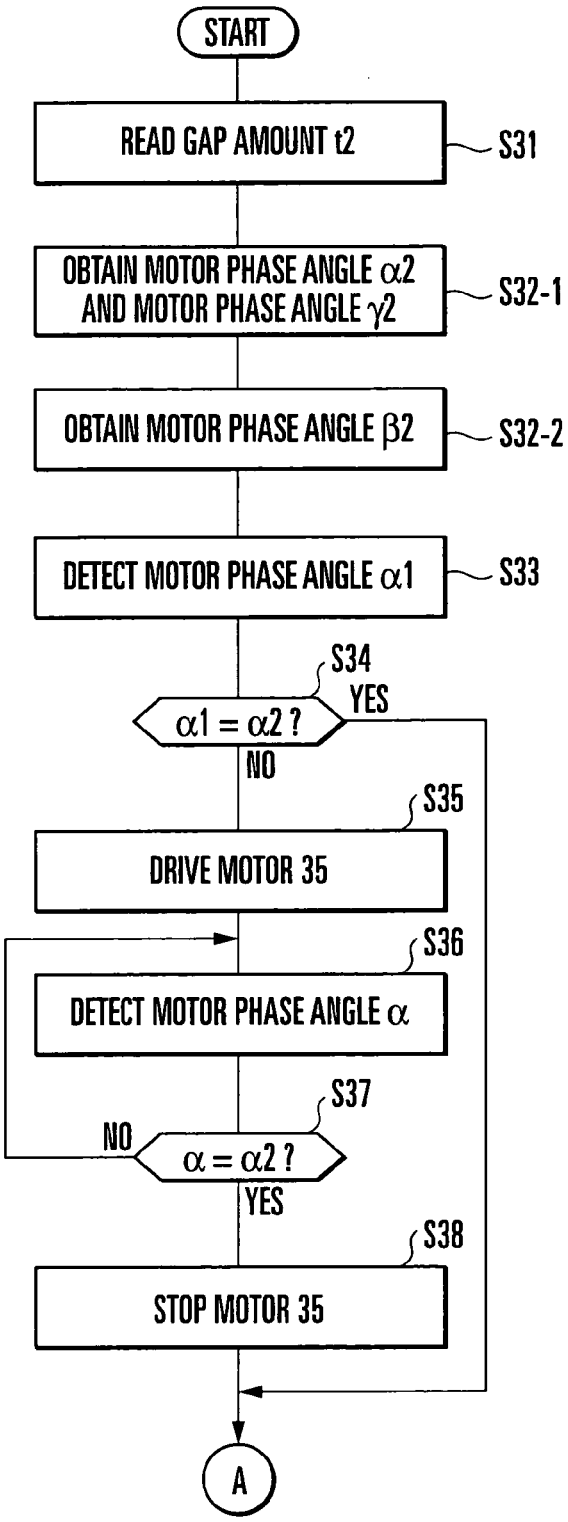
FIGS. 9A to 9C are flowcharts for explaining the operation of adjusting the gap amount t and the operation of controlling printing pressures between respective cylinders in the sheet processing apparatus shown in FIG. 7A.
Figure 9B:
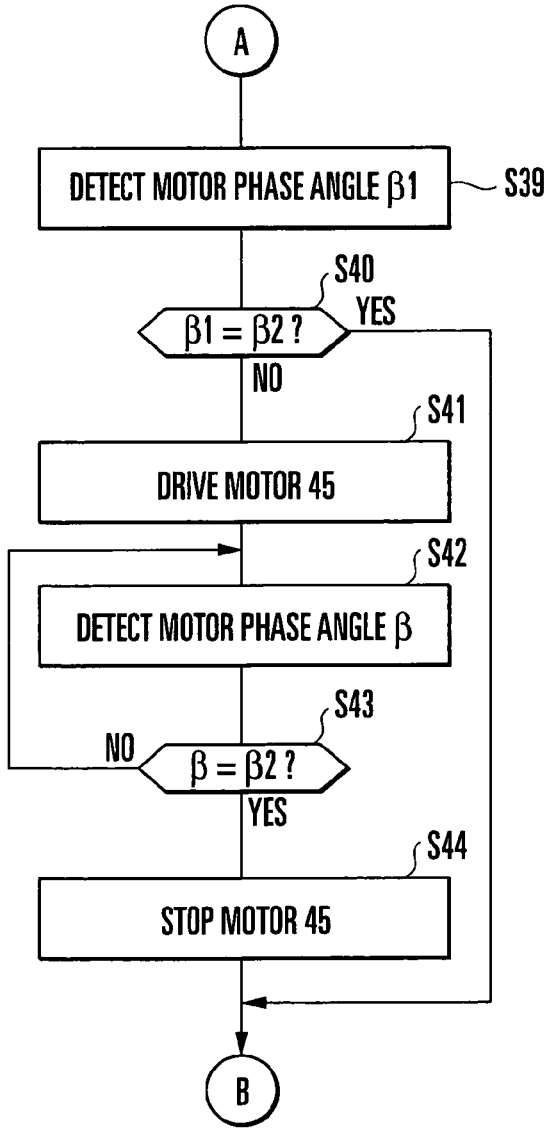
Figure 9C:
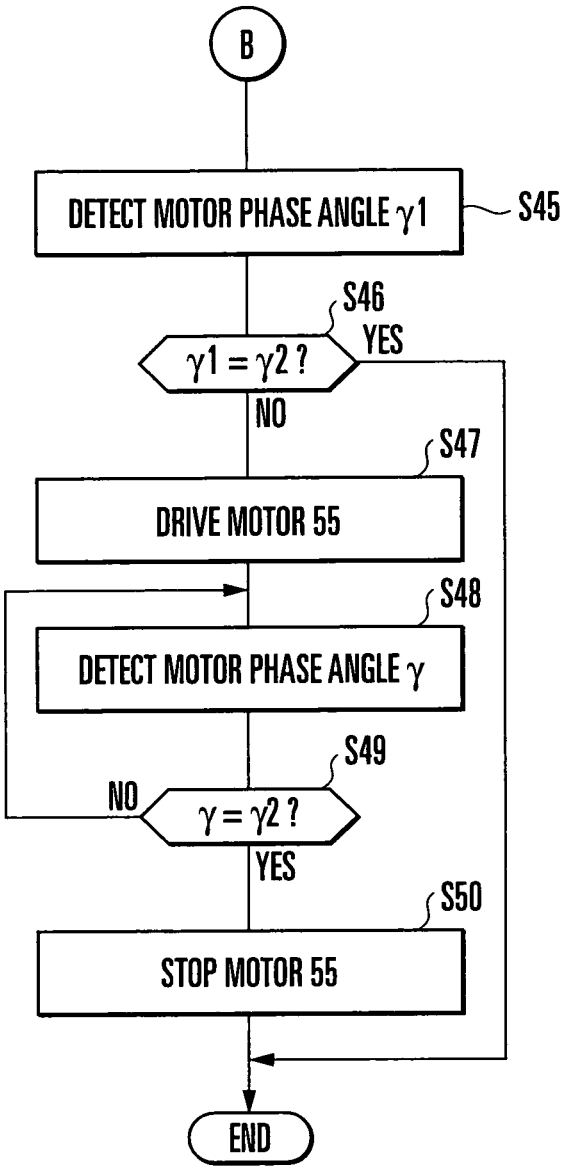

The adjustment and control operation of the first embodiment will be described with reference to FIGS. 9A to 9C. The controller 167 reads the gap amount t2 input to the gap amount input device 65 (step S31). The controller 167 then obtains the phase angle α2 of the motor 35 and the phase angle γ2 of the motor 55 from the readout gap amount t2 by looking up the conversion tables 68*a* and 168*c* (step S32-1).

The controller 167 obtains the phase angle β2 of the motor 45 from the gap amount t2 and the sheet thickness k=k3 (step S32-2). The controller 167 then detects the current phase angle α1 of the motor 35 on the basis of the output from the potentiometer 38 (step S33).

Then, the phase angles α1 and α2 are compared (step S34). If α1=α2, the phase angle α of the motor 35 is the phase angle α2 obtained from the gap amount t2. Thus, the motor 35 is not driven, and the process advances to step S39.

If NO in step S34, the motor 35 is driven (step S35). The current phase angle α of the motor 35 is detected on the basis of the output from the potentiometer 38 (step S36). If α=α2 (YES in step S37), the motor 35 is stopped (step S38). Thus, the coater double-diameter blanket cylinder 22 is adjusted to the position where its gap amount with respect to the impression cylinder 10*b* is t2.

If NO in step S37, the motor 35 is kept driven, and steps S36 and S37 are repeated until α=α2 is obtained. Namely, the controller 167 controls the motor 35 such that the current motor phase angle detected from the potentiometer 38 becomes the phase angle obtained from the conversion table 68*a*.

The controller 167 then detects the current phase angle β1 of the motor 45 on the basis of the output from the potentiometer 48 (step S39). The current phase angle β1 of the motor 45 is compared with the phase angle β2 of the motor 45 which is obtained from the phase angle β2 of the motor 35 and the sheet thickness k=k3 (step S40). If β1=β2, the phase angle β of the motor 45 is the phase angle β2 obtained from the phase angle α2 of the motor 35. Thus, the motor 45 is not driven, and the process advances to step S45.

If NO in step S40, the motor 45 is driven (step S41). The current phase angle β of the driven motor 45 is detected on the basis of the output from the potentiometer 48 (step S42). If D=β2 (YES in step S43), the motor 45 is stopped (step S44). Thus, the upper blanket cylinder 25 is positionally adjusted to maintain its printing pressure with respect to the coater double-diameter blanket cylinder 22 which is obtained before position adjustment.

If NO in step S43, the motor 45 is kept driven, and steps S42 and S43 are repeated until β=β2 is obtained.

The controller 167 then detects the current phase angle γ1 of the motor 55 on the basis of the output from the potentiometer 58 (step S45). The current phase angle γ1 of the motor 55 is compared with the phase angle γ2 of the motor 55 which is obtained from the phase angle α2 of the motor 35 (step S46). If γ1=γ2, the phase angle γ of the motor 55 is the phase angle γ2 obtained from the phase angle α2 of the motor 35. Thus, the motor 55 is not driven, and the control operation is ended.

If NO in step S46, the motor 55 is driven (step S47). The controller 167 detects the current phase angle γ of the driven motor 55 on the basis of the output from the potentiometer 58 (step S48). If γ=γ2 (YES in step S49), the motor 55 is stopped (step S50).

If NO in step S49, the motor 55 is kept driven, and steps S48 and S49 are repeated until γ=γ2 is obtained. Thus, the lower blanket cylinder 29 is positionally adjusted to maintain its printing pressure with respect to the coater double-diameter blanket cylinder 22 which is obtained before position adjustment.

Figure 15:
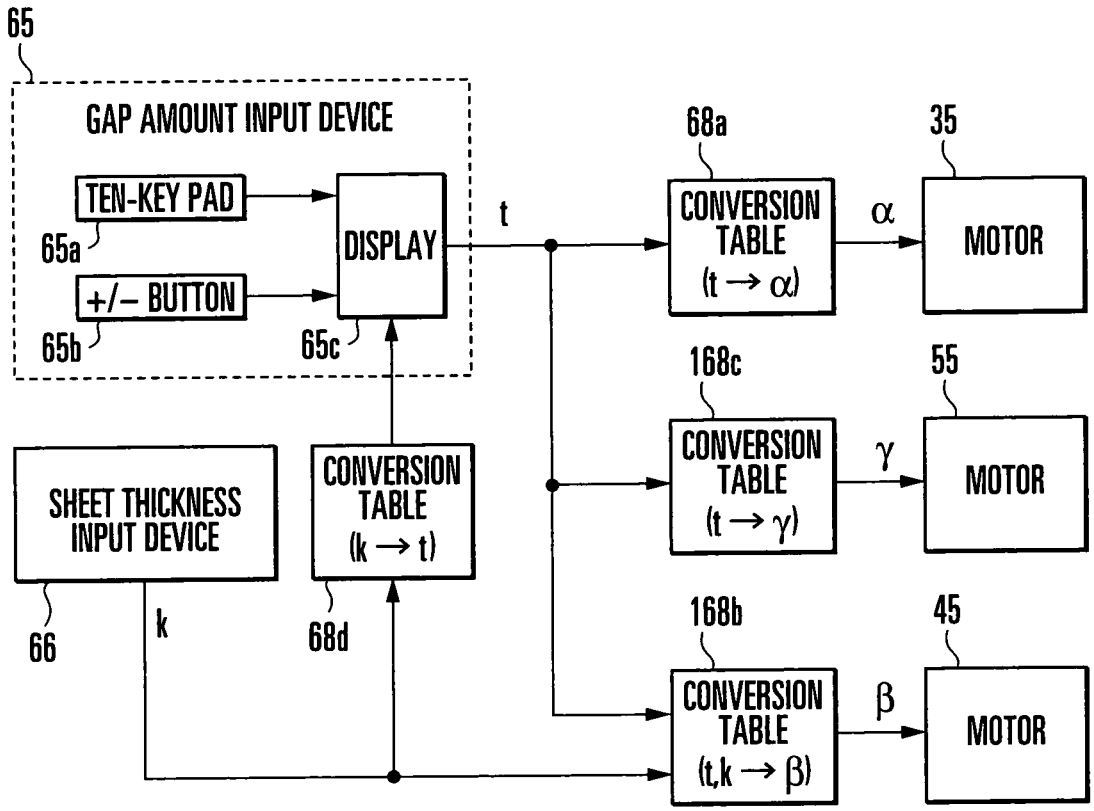
FIG. 15 is a diagram showing a data sequence in the sheet processing apparatus according to the first embodiment of the present invention.

The data sequence of this embodiment will be described with reference to FIG. 15. First, the sheet thickness k is input to the sheet thickness input device 66. In the conversion table 68*d*, the sheet thickness k input from the sheet thickness input device 66 is converted into the gap amount t. The display 65*c* of the gap amount input device 65 displays the gap amount t. By input operation from the ten-key pad 65*a* of the gap amount input device 65, the gap amount t is directly input, or the gap amount t converted from the sheet thickness k is changed. The display 65*c* displays the gap amount t input or changed by the ten-key pad 65*a*. The +/− button 65*b* is manipulated to finely adjust the gap amount t displayed on the display 65*c*. In the conversion table 68*a*, the phase angle α is obtained from the gap amount t displayed on the display 65*c*. The motor 35 is driven to have the phase angle α obtained from the conversion table 68*a*.

In the conversion tables 68*a* and 168*c*, the phase angles α and γ are obtained from the gap amount t displayed on the display 65*c*. The motors 35 and 55 are driven to have the phase angles α and γ obtained from the conversion tables 68*a* and 168*c*, respectively. In the conversion table 168*b*, the phase angle β is obtained from the gap amount t displayed on the display 65*c* and the sheet thickness k input to the sheet thickness input device 66. The motor 45 is driven to have the phase angle β obtained from the conversion table 168*b*.

The second embodiment of the present invention will be described with reference to FIGS. 10 to 12D. According to this embodiment, the driving amount of the motor 45 is controlled by adding the amount of printing pressure adjustment of the motor 45, which accompanies adjustment of the printing pressure between a coater double-diameter blanket cylinder 22 and upper blanket cylinder 25 that takes place before the gap amount adjustment, to the driving amount of a motor 45 obtained on the basis of a gap amount t which is input to a gap amount input device 65. The driving amount of a motor 55 is controlled by adding the amount of printing pressure adjustment of the motor 55, which accompanies adjustment of the printing pressure between the coater double-diameter blanket cylinder 22 and a lower blanket cylinder 29 that takes place before gap amount adjustment, to the driving amount of the motor 55 obtained on the basis of the gap amount t which is input to the gap amount input device 65.

Figure 10:
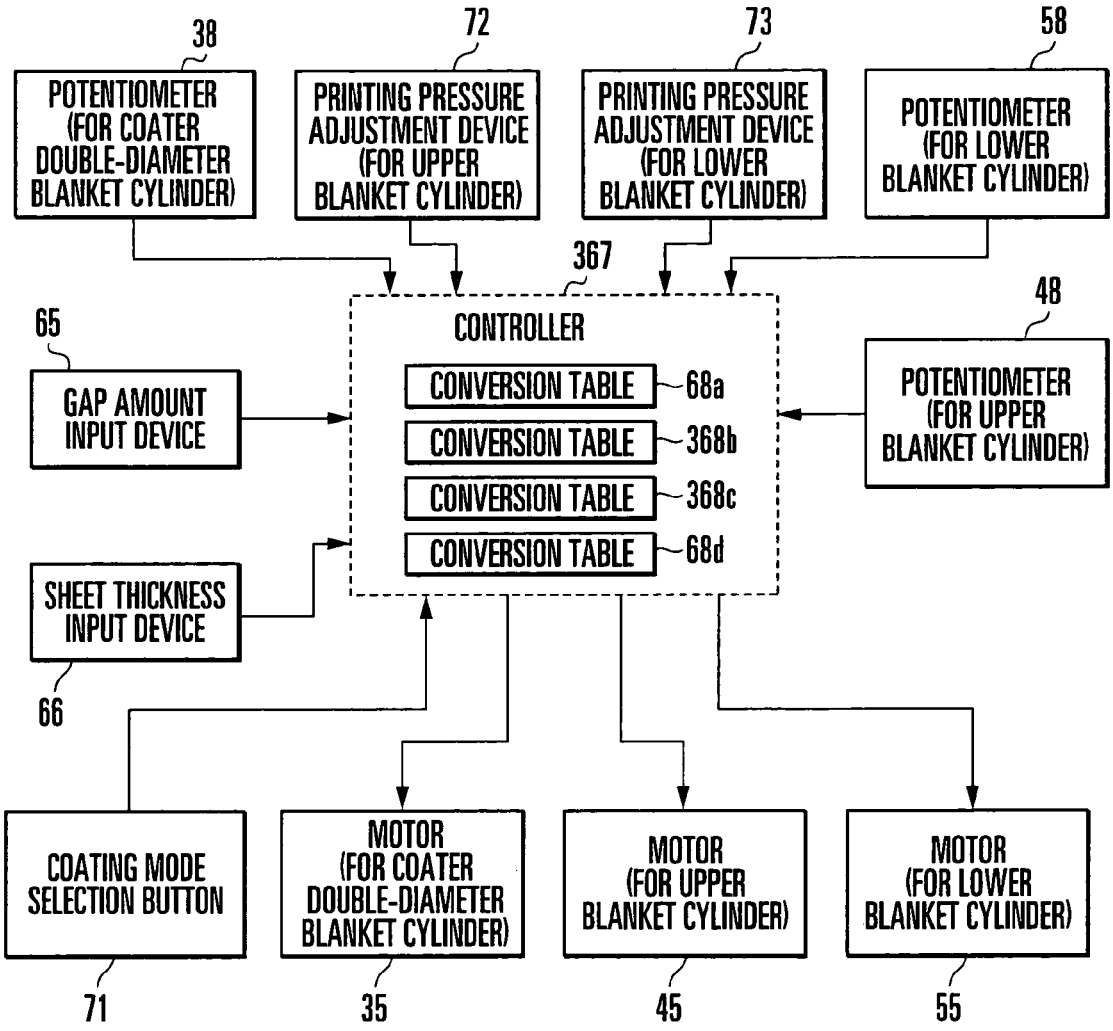
FIG. 10 is a block diagram showing the electrical arrangement of a sheet processing apparatus according to the second embodiment of the present invention.
Figure 11A:
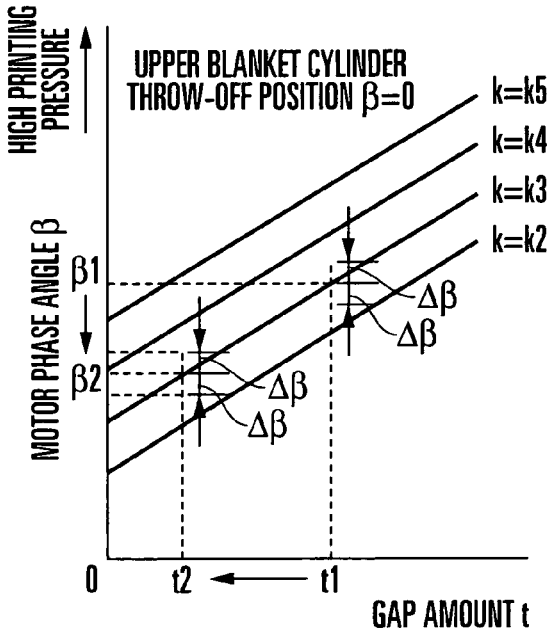
FIG. 11A is a graph defining the relationship "between a gap amount t and a motor phase angle $\beta$" of the second conversion table shown in FIG. 10.
Figure 11B:
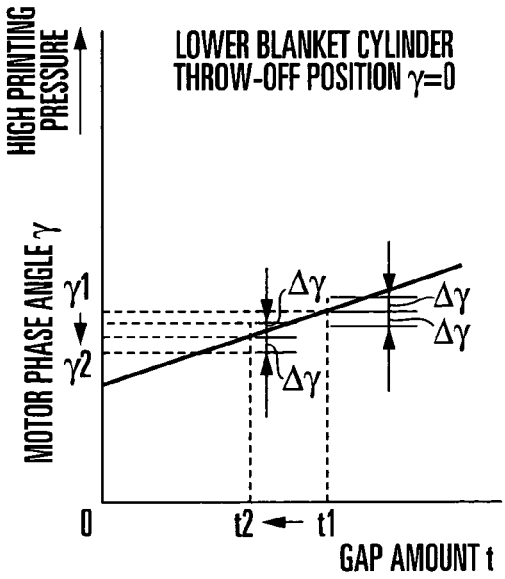
FIG. 11B is a graph defining the relationship "between the gap amount t and a motor phase angle $\gamma$" of the third conversion table shown in FIG. 10.
Figure 12A:
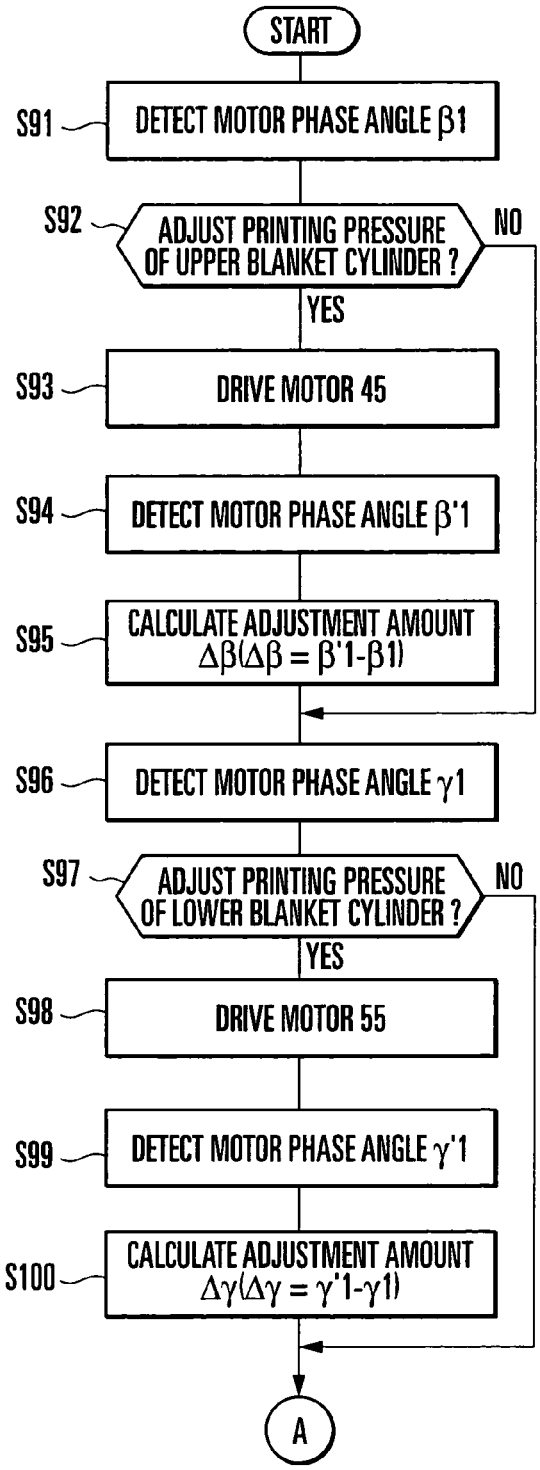
FIGS. 12A to 12D are flowcharts for explaining the operation of adjusting a gap amount t and the operation of controlling printing pressures between respective cylinders in the sheet processing apparatus shown in FIG. 10.
Figure 12B:
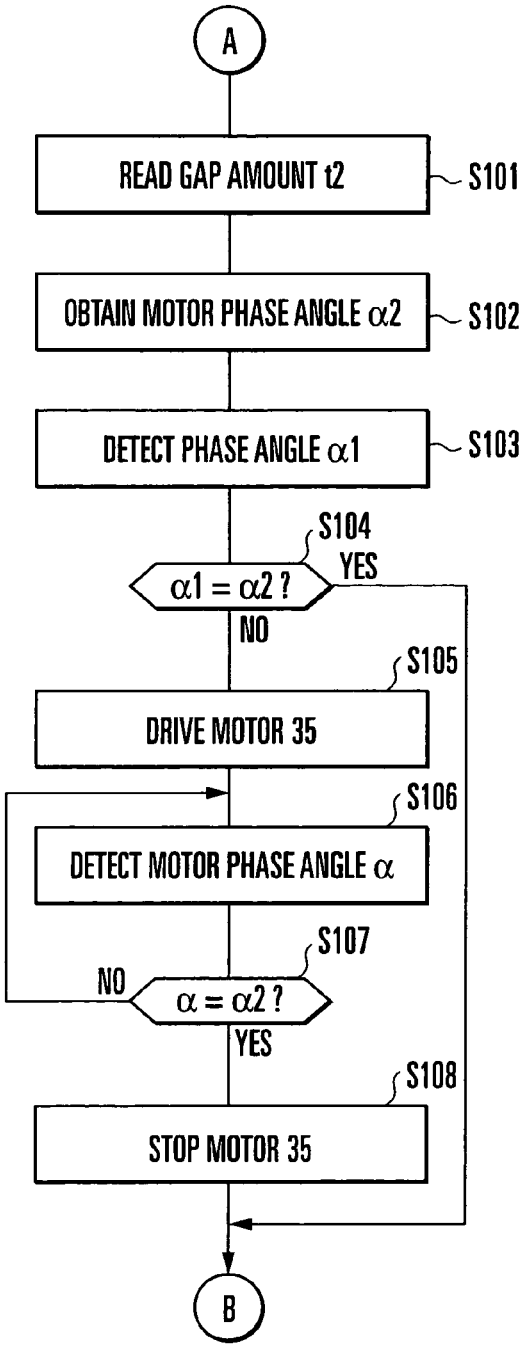
Figure 12C:
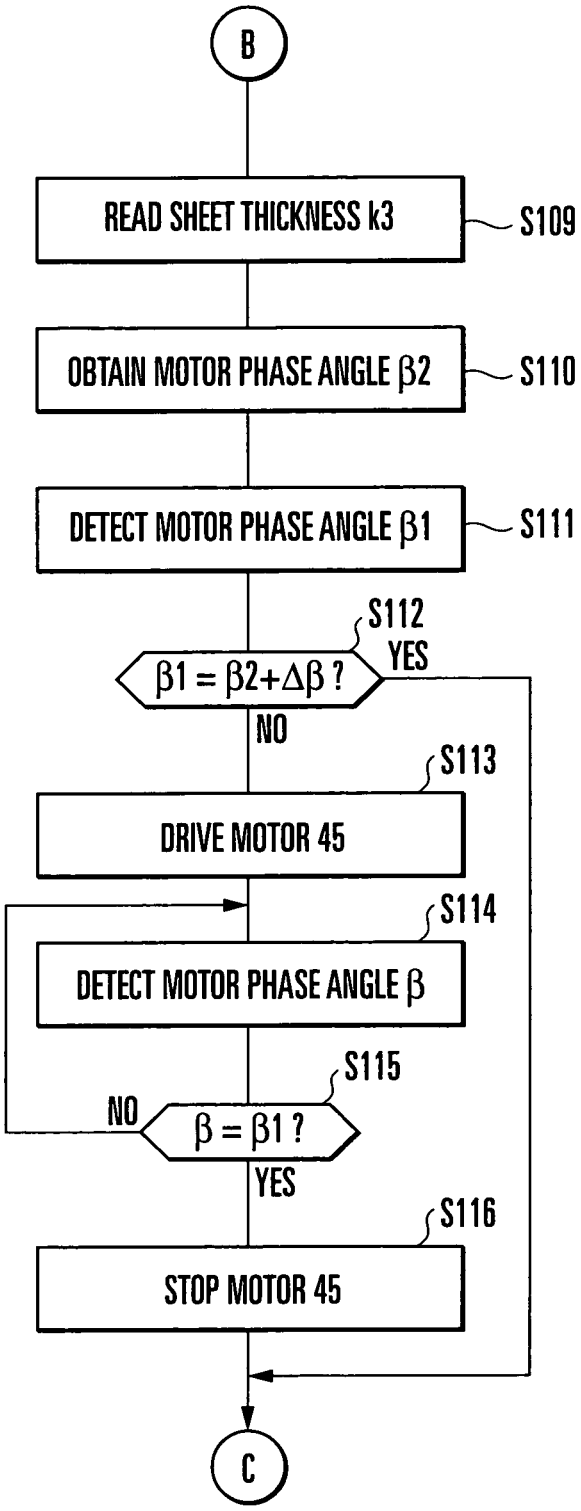
Figure 12D:
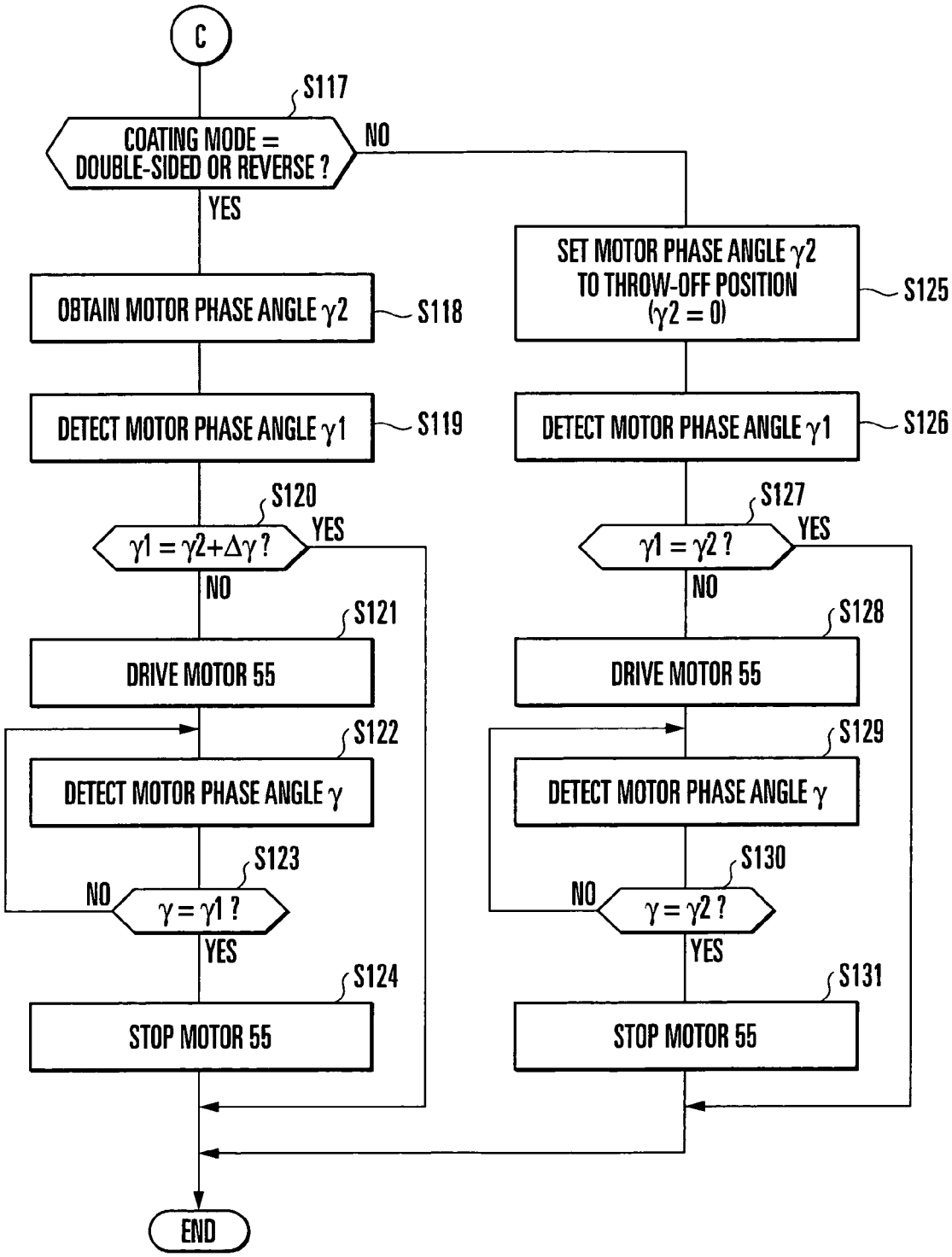

As shown in FIG. 10, this embodiment further comprises a coating mode selection button 71, a printing pressure adjustment device 72 for the upper blanket cylinder, and a printing pressure adjustment device 73 for the lower blanket cylinder, in addition to the arrangement of the first embodiment. The coating mode selection button 71 (coating mode selection means) performs selection among double-sided coating, reverse coating, and obverse coating. The printing pressure adjustment device 72 drives the motor 45 by a manual operation to adjust the printing pressure between the coater double-diameter blanket cylinder 22 and upper blanket cylinder 25. The printing pressure adjustment device 73 drives the motor 55 by a manual operation to adjust the printing pressure between the coater double-diameter blanket cylinder 22 and lower blanket cylinder 29.

A controller 367 has a first conversion table 68*a* defining the relationship "between the gap amount t and the phase angle α of the motor 35" (FIG. 8A), a second conversion table 368*b* defining the relationship "between the gap amount t and a phase angle β of the motor 45 with respect to a sheet thickness k" (FIG. 11A), a third conversion table 368*c* defining the relationship "between the gap amount t and a phase angle γ of the motor 55" (FIG. 11B), and a fourth conversion table 68*d* defining the relationship "between the sheet thickness k and gap amount t" (FIG. 8D).

The controller 367 obtains the gap amount t from the sheet thickness k input to a sheet thickness input device 66 by looking up the conversion table 68*d*, and outputs the gap amount t to the gap amount input device 65. The controller 367 obtains the phase angle α of the motor 35 from the gap amount t input to the gap amount input device 65 by looking up the conversion table 68*a*. The controller 367 obtains the phase angle β of the motor 45 from the gap amount t input to the gap amount input device 65 and the sheet thickness k input to the sheet thickness input device 66 by looking up the conversion table 368*b*. At this time, the controller 367 adds (by addition or subtraction) an amount corresponding to a printing pressure adjustment amount Δβ, which is adjusted by the printing pressure adjustment device 72 when the motor 45 has a phase angle β1, to a phase angle β2 obtained after adjustment.

More specifically, when the sheet thickness satisfies k=k3 and the gap amount t=t1, the phase angle β1 of the motor 45 is temporarily obtained. At this time, the printing pressure adjustment amount Δβ obtained by the printing pressure adjustment device 72 is added to the phase angle β1. Subsequently, when the gap amount is changed from t1 to t2, the phase angle β2 of the motor 45 is temporarily obtained. The printing pressure adjustment amount Δβ obtained before the change is added to the temporarily obtained phase angle β2, thus obtaining a phase angle (β2+Δβ).

If the phase angle (β2+Δβ) is adjusted by Δβ in a direction to decrease the printing pressure, Δβ has a negative value, and accordingly a phase angle obtained by subtracting Δβ from β2 is obtained. If the phase angle (β2+Δβ) is adjusted by Δβ in a direction to increase the printing pressure, $\Delta\beta$ has a positive value, and accordingly a phase angle obtained by adding $\Delta\beta$ to $\beta 2$ is obtained.

In this manner, upon the change of the gap amount input to the gap amount input device 65 from t1 to t2, the phase angle of the motor 45 is changed from $\beta 1$ to $\beta 2$. At this time, the printing pressure adjustment amount which is adjusted before the change is added to the printing press between the coater double-diameter blanket cylinder 22 and upper blanket cylinder 25 which is obtained after the change, thus maintaining the printing pressure in the same state.

The controller 367 obtains the phase angle $\gamma$ of the motor 55 from the gap amount t input to the gap amount input device 65 by looking up the conversion table 368*c*. At this time, the controller 367 adds a printing pressure adjustment amount $\Delta\gamma$, which is obtained by adjusting a phase angle $\gamma 1$ of the motor 55 by the printing pressure adjustment device 73, to a phase angle $\gamma 2$ obtained after the adjustment.

More specifically, when the gap amount t is t1, the phase angle $\gamma 1$ of the motor 55 is temporarily obtained. At this time, the printing pressure adjustment amount $\Delta\gamma$ obtained by the printing pressure adjustment device 73 is added to the phase angle $\gamma$ of the motor 55. Subsequently, when the gap amount is changed from t1 to t2, the phase angle $\gamma 2$ of the motor 55 is temporarily obtained. The printing pressure adjustment amount $\Delta\gamma$ is added to the temporarily obtained phase angle $\gamma 2$ of the motor 55, thus obtaining a phase angle $(\gamma 2+\Delta\gamma)$ of the motor 55.

In this manner, upon the change of the gap amount input to the gap amount input device 65 from t1 to t2, the phase angle of the motor 55 is changed from $\gamma 1$ to $\gamma 2$. At this time, the printing pressure adjustment amount which is adjusted before the change is added to the printing press between the coater double-diameter blanket cylinder 22 and lower blanket cylinder 29 which is obtained after the change, thus maintaining the printing pressure in the same state.

The adjustment and control operation of the second embodiment will be described with reference to FIGS. 12A to 12D. The controller 367 detects the phase angle $\beta 1$ of the motor 45 on the basis of an output from a potentiometer 48 (step S91). The operator then determines whether or not to adjust the printing pressure between the upper blanket cylinder 25 and coater double-diameter blanket cylinder 22 by the printing pressure adjustment device 72 (step S92).

If printing pressure adjustment is not necessary, the process advances to step S96. If printing pressure adjustment is necessary, the controller 367 drives the motor 45 to perform adjustment (step S93). Then, a phase angle $\beta'1$ of the upper blanket cylinder 25 is detected on the basis of the output from the potentiometer 48 (step S94). The amount $\Delta\beta=\beta'1-\beta 1$ of printing pressure adjustment for the upper blanket cylinder 25 which is to be performed by the printing pressure adjustment device 72 is calculated (step S95). The phase angle $\gamma 1$ of the lower blanket cylinder 29 is detected on the basis of an output from a potentiometer 58 (step S96).

The operator then determines whether or not to adjust the printing pressure between the lower blanket cylinder 29 and coater double-diameter blanket cylinder 22 by the printing pressure adjustment device 73 (step S97). If printing pressure adjustment is not necessary, the process advances to step S101. If printing pressure adjustment is necessary, the motor 55 is driven to perform adjustment (step S98). Then, a phase angle $\gamma'1$ of the lower blanket cylinder 29 is detected on the basis of the output from the potentiometer 58 (step S99). The amount $\Delta\gamma=\gamma'1-\gamma 1$ of printing pressure adjustment for the lower blanket cylinder 29 which is to be performed by the printing pressure adjustment device 73 is calculated (step S100).

The controller 367 reads the gap amount t2 input to the gap amount input device 65 (step S101). The controller 367 obtains the phase angle $\alpha 2$ of the motor 35 from the readout gap amount t2 by looking up the conversion table 68*a* (step S102). The controller 367 then detects the current phase angle $\alpha 1$ of the motor 35 on the basis of the output from the potentiometer 38 (step S103).

Then, the phase angles $\alpha 1$ and $\alpha 2$ are compared (step S104). If $\alpha 1=\alpha 2$, the phase angle $\alpha$ of the motor 35 is the phase angle $\alpha 2$ obtained from the gap amount t2. Thus, the motor 35 is not driven, and the process advances to step S109.

If NO in step S104, the motor 35 is driven (step S105). The current phase angle $\alpha$ of the motor 35 is detected on the basis of the output from the potentiometer 38 (step S106). If $\alpha=\alpha 2$ (YES in step S107), the motor 35 is stopped (step S108). Thus, the coater double-diameter blanket cylinder 22 is adjusted to the position where its gap amount with respect to the impression cylinder 10*b* is t2.

If NO in step S107, the motor 35 is kept driven, and steps S106 and S107 are repeated until $\alpha=\alpha 2$ is obtained. Namely, the controller 367 controls the motor 35 such that the current motor phase angle detected from the potentiometer 38 becomes the phase angle obtained from the conversion table 68*a*.

The controller 367 then reads the sheet thickness k=k3 input to the sheet thickness input device 66 (step S109). The controller 367 obtains the phase angle $\beta 2$ of the motor 45 from the gap amount t2 and the sheet thickness k3 by looking up the conversion tables 368*b* and 368*c* (step S110). The current phase angle $\beta 1$ of the motor 45 is detected on the basis of the output from the potentiometer 48 (step S111).

The controller 367 compares the current phase angle $\beta 1$ of the motor 45 with $(\beta 2+\Delta\beta)$ which is obtained by adding the adjustment amount $\Delta\beta$, input from the gap amount input device 65, to the phase angle $\Delta 2$ of the motor 45 obtained from the gap amount t2 and the sheet thickness k3 (step S112). If $\beta 1=\beta 2+\Delta\beta$, the phase angle $\beta$ of the motor 45 is a value obtained by adding the adjustment amount $\Delta\beta$ to the phase angle $\beta 2$ obtained from the gap amount t2 and the sheet thickness k3. Thus, the motor 45 is not driven, and the process advances to step S117.

If NO in step S112, the controller 367 drives the motor 45 (step S113). The current phase angle $\beta$ of the driven motor 45 is detected on the basis of the output from the potentiometer 48 (step S114). If $\beta=\beta 2+\Delta\beta$ (YES in step S115), the motor 45 is stopped (step S116). Thus, the upper blanket cylinder 25 is positionally adjusted to maintain its printing pressure with respect to the coater double-diameter blanket cylinder 22 which is obtained before position adjustment.

If NO in step S115, the motor 45 is kept driven, and steps S114 and S115 are repeated until $\beta=\beta 2+\Delta\beta$ is obtained.

The controller 367 checks whether or not double-sided coating or reverse coating is selected by the coating mode selection button 71 (step S117). If the double-sided coating or reverse coating mode is selected, the controller 367 obtains the phase angle $\gamma 2$ of the motor 55 from the gap amount t2 by looking up the conversion table 368*c* (step S118).

Subsequently, the controller 367 detects the current phase angle $\gamma 1$ of the motor 55 on the basis of the output from the potentiometer 58 (step S119). Then, the controller 367 compares the current phase angle $\gamma 1$ of the motor 55 with $(\gamma 2+\Delta\gamma)$ which is obtained by adding the adjustment amount $\Delta\gamma$, input from the gap amount input device 65, to the phase angle $\gamma 2$ of the motor 55 obtained from the phase angle $\alpha 2$ of the motor 35 (step S120). If $\gamma 1=\gamma 2+\Delta\gamma$, the phase angle $\gamma$ of the motor 55 is a value obtained by adding the adjustment amount $\Delta\gamma$ to the phase angle $\gamma 2$ calculated from the phase angle $\alpha 2$ of the motor 35. Thus, the motor 55 is not driven, and the control operation is ended.

If NO in step S120, the controller 367 drives the motor 55 (step S121). The controller 367 detects the current phase angle $\gamma$ of the driven motor 55 on the basis of the output from the potentiometer 58 (step S122). If $\gamma=\gamma 2+\Delta\gamma$ (YES in step S123), the motor 55 is stopped (step S124).

If NO in step S123, the motor 55 is kept driven, and steps S122 and S123 are repeated until $\gamma=\gamma 2+\Delta\gamma$ is obtained. Thus, the lower blanket cylinder 29 is positionally adjusted to maintain its printing pressure with respect to the coater double-diameter blanket cylinder 22 which is obtained before position adjustment.

If not the double-sided or reverse coating mode but the obverse coating mode is selected (NO in step S117), the lower blanket cylinder 29 is set at the throw-off position, i.e., at a position corresponding to the phase angle $\gamma 2=0$ of the motor 55 (step S125). The current phase angle $\gamma 1$ of the motor 55 is detected on the basis of the output from the potentiometer 58 (step S126). The current phase angle $\gamma 1$ of the motor 55 is compared with the phase angle $\gamma 2$ of the motor 55 which is obtained from the phase angle $\alpha 2$ of the motor 35 (step S127).

If $\gamma 1=\gamma 2$, the phase angle $\gamma$ of the motor 55 is the phase angle $\gamma 2$ obtained from the phase angle $\alpha 2$ of the motor 35. Thus, the motor 55 is not driven, and the control operation is ended. If NO in step S127, the controller 367 drives the motor 55 (step S128). The controller 367 detects the current phase angle $\gamma$ of the driven motor 55 on the basis of the output from the potentiometer 58 (step S129). If $\gamma=\gamma 2$ (YES in step S130), the motor 55 is stopped (step S131).

If NO in step S130, the motor 55 is kept driven, and steps S129 and S130 are repeated until $\gamma=\gamma 2$ is obtained. Thus, the lower blanket cylinder 29 is positionally adjusted to maintain its printing pressure with respect to the coater double-diameter blanket cylinder 22 which is obtained before position adjustment.

The second embodiment has exemplified a case in which the phase angle $\beta$ of the motor 45 and the phase angle $\gamma$ Of the motor 55 are obtained on the basis of the gap amount t input to the gap amount input device 65. However, the present invention is not limited to this. The phase angles $\beta$ and $\gamma$ may be obtained not directly from the gap amount t but from the phase angle $\alpha$ which is obtained from the gap amount t.

In FIG. 7 (the first embodiment) and FIG. 10 (the second embodiment), the sheet thickness input device 66 is exemplified by a ten-key input device to which the sheet thickness k is input by the operator's key operation. Alternatively, a sheet thickness measurement device which measures the thickness of the sheet before printing automatically may be used.

Figure 13:
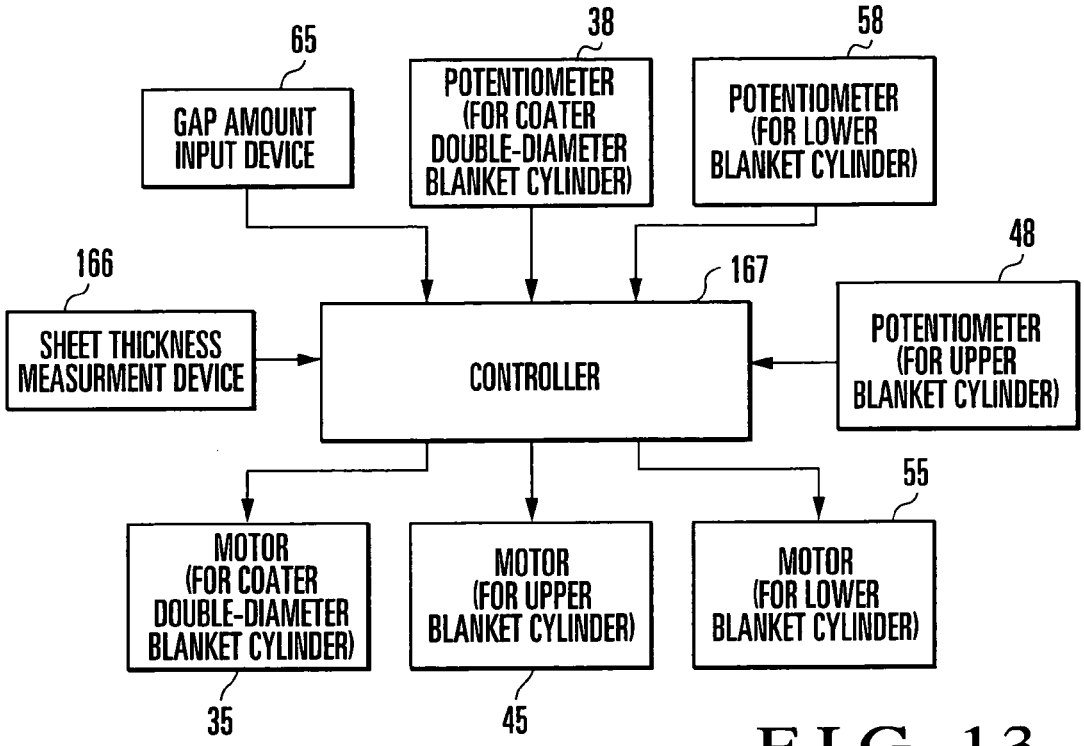
FIG. 13 is a block diagram showing the electrical arrangement of a sheet processing apparatus according to the third embodiment of the present invention.

FIG. 13 shows the third embodiment of the present invention which uses a sheet thickness measurement device. This embodiment comprises a sheet thickness measurement device 166 in place of the sheet thickness input device 66 in FIG. 7. A controller 167 controls motors 35, 45, and 55 on the basis of the measurement result of the sheet thickness measurement device 166.

In FIG. 7 (the first embodiment) and FIG. 10 (the second embodiment), the sheet thickness input device 66 is exemplified by a ten-key input device to which the sheet thickness k is input by the operator's key operation. Alternatively, a sheet thickness reading device which reads a barcode formed on a sheet before printing or code information stored in an IC tag prepared for each sheet lot may be used.

Figure 14:
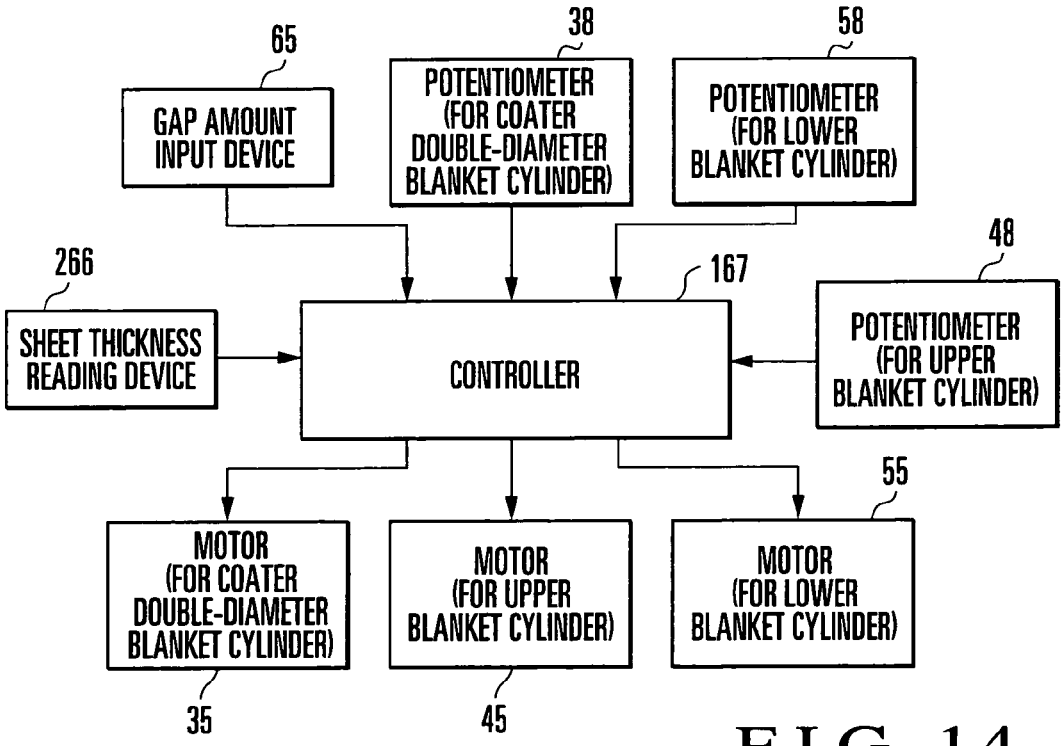
FIG. 14 is a block diagram showing the electrical arrangement of a sheet processing apparatus according to the fourth embodiment of the present invention.

FIG. 14 shows the fourth embodiment of the present invention which uses a sheet thickness reading device. This embodiment comprises a sheet thickness reading device 266 in place of the sheet thickness input device 66 in FIG. 7. A controller 167 controls motors 35, 45, and 55 on the basis of the readout result of the sheet thickness reading device 266.

In the above embodiments, if $\alpha 1=\alpha 2$ is not satisfied in steps S34 and S104, the motor 35 is driven so that $\alpha=\alpha 2$ is obtained by repeating steps S35 to S37 and S105 to S107. However, the present invention is not limited to this. If $\alpha 1=\alpha 2$ is not satisfied, $\alpha 1-\alpha 2$ may be calculated to obtain the difference, and the motor 35 may be driven by an amount corresponding to the difference.

Similarly, if $\beta 1=\beta 2$ is not satisfied in step S40, $\beta 1-\beta 2$ may be calculated to obtain the difference, and the motor 45 may be driven by an amount corresponding to the difference. Similarly, if $\gamma 1=\gamma 2$ is not satisfied in step S46, $\gamma 1-\gamma 2$ may be calculated to obtain the difference, and the motor 55 may be driven by an amount corresponding to the difference.

In the above embodiments, the coater double-diameter blanket cylinder 22, upper blanket cylinder 25, and lower blanket cylinder 29 of the coating unit 4 are described. The same explanation may be applied to the impression cylinders 10*a* and 10*b* and blanket cylinders 11*a* and 11*b* in the printing unit 3. Three conversion tables are used to obtain the phase angles of the motors 35, 45, and 55. The motor phase angles may be calculated by using calculation equations in place of the conversion tables.

As has been described above, according to the present invention, when transferring a sheet from the transport cylinder to the first cylinder, if the sheet is scratched depending on the thickness or material of the sheet, the controller drives the first driving means to adjust the gap amount between the first cylinder and transport cylinder. Not only adjustment can be performed within a short period of time, but also the load to the operator can be reduced and the productivity can be improved.

As the gap amount between the first cylinder and the upstream transport cylinder is adjusted, the second and third driving means are driven to adjust the printing pressures of the second and third cylinders. This enables adjustment to maintain the printing quality to complete within a short period of time. This can also decrease waste paper.

What is claimed is:

1. A sheet processing apparatus comprising:

a first cylinder which receives a sheet from an upstream transport cylinder and holds the sheet and functions as a reference cylinder for adjustment of a printing pressure;

a second cylinder which is disposed to oppose said first cylinder and prints/coats the sheet held by said first cylinder;

a third cylinder which is disposed to oppose said first cylinder and supplies ink/varnish to a circumferential surface of said first cylinder;

first driving means for moving a position of said first cylinder with respect to said upstream transport cylinder to adjust a gap amount between said first cylinder and said upstream transport cylinder;

second driving means for moving a position of said second cylinder with respect to said first cylinder to adjust the printing pressure between said first cylinder and said second cylinder;

third driving means for moving a position of said third cylinder with respect to said first cylinder to adjust the printing pressure between said first cylinder and said third cylinder;

gap amount input means for inputting the gap amount between said first cylinder and said upstream transport cylinder;

control means for controlling the driving operation of said first driving means, said second driving means, and said third driving means on the basis of the gap amount input from said gap amount input means; and thickness input means for inputting a thickness of the sheet, wherein said control means controls the second driving means based on said sheet thickness.

2. An apparatus according to claim 1, wherein said control means controls said second driving means and said third driving means such that a printing pressure between said first cylinder and said second cylinder before gap amount adjustment and a printing pressure between said first cylinder and said third cylinder before gap amount adjustment are maintained after gap amount adjustment.

3. An apparatus according to claim 1, further comprising a first table defining a relationship between the gap amount and a position of said first cylinder, a second table defining a relationship between the gap amount and the position of said second cylinder, and a third table defining a relationship between the gap amount and the position of said third cylinder, wherein said control means controls said first driving means, said second driving means, and said third driving means in accordance with the gap amount obtained from said first table, said second table, and said third table.

4. An apparatus according to claim 1, wherein said control means controls said second driving means in accordance with a current position of said second cylinder and an adjusted position of said second cylinder based on the gap amount from said gap amount input means, and said third driving means in accordance a current position of said third cylinder and an adjusted position of said third cylinder based on the gap amount from said gap amount input means.

5. An apparatus according to claim 1, wherein said upstream transport cylinder comprises an impression cylinder.

6. An apparatus according to claim 1, further comprising process mode selection means for selecting a process mode for the sheet among a double-sided mode of printing/coating two surfaces of the sheet, an obverse mode of printing/coating only an obverse of the sheet, and a reverse mode of printing/coating only a reverse of the sheet, wherein said control means controls said third driving means in accordance with the process mode selected by said process mode selection means.

7. An apparatus according to claim 6, wherein when the process mode is one of the double-sided mode and the reverse mode, said control means controls said third driving means such that the third cylinder comes into contact with said first cylinder, and when the process mode is the obverse mode, said control means controls said third driving means such that said third cylinder separates from said first cylinder.

8. An apparatus according to claim 1, wherein said gap amount input means comprises a +/− button which changes a current gap amount by a predetermined gap amount in one of a + direction and a − direction with one manipulation.

9. An apparatus according to claim 1, further comprising a first varnish coating device which includes said second cylinder and coats one surface of the sheet held by said first cylinder, and a second varnish coating device which includes said first cylinder and said third cylinder and coats the other surface of the sheet held by said first cylinder.

10. An apparatus according to claim 9, wherein said first varnish coating device and said second varnish coating device further include a chamber coater, respectively.

11. An apparatus according to claim 9, wherein said upstream transport cylinder comprises an impression cylinder, and the sheet held by said impression cylinder is subjected to printing on the other surface thereof.

12. An apparatus according to claim 1, further comprising a printing unit including at least one obverse printing unit including a first impression cylinder which holds and conveys the sheet and a first transfer cylinder which is disposed to oppose said impression cylinder and prints an obverse of the sheet held by said impression cylinder, and at least one reverse printing unit including a second impression cylinder which holds and conveys the sheet and a second transfer cylinder which is disposed to oppose said impression cylinder and prints a reverse of the sheet held by said impression cylinder, and a coating unit which includes said first cylinder, said second cylinder, and said third cylinder and coats the obverse/reverse of the sheet, printed by said printing unit, with varnish, wherein said first cylinder and said second cylinder are disposed to oppose each other, and said first cylinder is arranged to oppose one of said first impression cylinder and said second impression cylinder.

13. An apparatus according to claim 1, wherein said first cylinder, said second cylinder, and said third cylinder are supported rotatably by an eccentric bearing, respectively.

14. An apparatus according to claim 1, wherein said control means controls the driving operation of said second driving means and said third driving means after the driving operation of said first driving means on the basis of the gap amount input from said gap amount input means, said second driving means moves the position of said second cylinder with respect to said first cylinder after the movement of said first cylinder, and said third driving means moves the position of said third cylinder with respect to said first cylinder after the movement of said first cylinder.

15. A sheet processing apparatus comprising:

a first cylinder which receives a sheet from an upstream transport cylinder and holds the sheet and functions as a reference cylinder for adjustment of a printing pressure;

a second cylinder which is disposed to oppose said first cylinder and prints/coats the sheet held by said first cylinder;

a third cylinder which is disposed to oppose said first cylinder and supplies ink/varnish to a circumferential surface of said first cylinder;

first driving means for moving a position of said first cylinder with respect to said upstream transport cylinder to adjust a gap amount between said first cylinder and said upstream transport cylinder;

second driving means for moving a position of said second cylinder with respect to said first cylinder to adjust the printing pressure between said first cylinder and said second cylinder;

third driving means for moving a position of said third cylinder with respect to said first cylinder to adjust the printing pressure between said first cylinder and said third cylinder;

gap amount input means for inputting the gap amount between said first cylinder and said upstream transport cylinder, and thickness input means for inputting a thickness of the sheet; and control means for further controlling the driving operation of said second driving means and said third driving means on the basis of the sheet thickness after the driving operation of said first driving means on the basis of the gap amount input from said gap amount input means, and further controlling the driving operation of said second driving means, on the basis of the sheet thickness, before gap amount adjustment by said first, second and third driving means, wherein said second driving means moves the position of said second cylinder with respect to said first cylinder after the movement of said first cylinder, and said third driving means moves the position of said third cylinder with respect to said first cylinder after the movement of said first cylinder.

16. A sheet processing apparatus comprising:

a first cylinder which receives a sheet from an upstream transport cylinder and holds the sheet;

a second cylinder which is disposed to oppose said first cylinder and prints/coats the sheet held by said first cylinder;

a third cylinder which is disposed to oppose said first cylinder and supplies ink/varnish to a circumferential surface of said first cylinder;

first driving means for adjusting a gap amount between said first cylinder and said upstream transport cylinder, wherein the first driving means moves the position of the first cylinder with respect to the upstream transport cylinder to adjust a gap amount between the first cylinder and the upstream transport cylinder;

second driving means for adjusting a position of said second cylinder with respect said first cylinder;

third driving means for adjusting a position of said third cylinder with respect to said first cylinder;

gap amount input means for inputting the gap amount between said first cylinder and said upstream transport cylinder;

control means for controlling said first driving means, said second driving means, and said third driving means on the basis of the gap amount input from said gap amount input means;

thickness input means for inputting a thickness of the sheet; and a table defining a relationship between the thickness of the sheet and the gap amount, wherein said control means controls said second driving means in accordance with a gap amount based on the sheet thickness from said thickness input means;

wherein said control means further controls said second driving means in accordance with the gap amount based on the sheet thickness from said sheet thickness input means, and thereafter controls said first driving means on the basis of the gap amount from said gap amount input means, thereby finely adjusting the position of said first cylinder.

* * * * *

UNITED STATES PATENT AND TRADEMARK OFFICE

CERTIFICATE OF CORRECTION

PATENT NO. : 8,459,181 B2
APPLICATION NO. : 12/070625
DATED : June 11, 2013
INVENTOR(S) : Hirofumi Saito It is certified that error appears in the above-identified patent and that said Letters Patent is hereby corrected as shown below:

In the Claims:

Column 18, Claim 16, line 6, delete "respect said" and insert --respect to said--.

Signed and Sealed this
Eighth Day of October, 2013

Teresa Stanek Rea

Teresa Stanek Rea
*Deputy Director of the United States Patent and Trademark Office*